US012303092B2

(12) United States Patent
Hong et al.

(10) Patent No.: US 12,303,092 B2
(45) Date of Patent: May 20, 2025

(54) CLEANING UNIT COMPRISING AGITATOR

(71) Applicant: LG ELECTRONICS INC., Seoul (KR)

(72) Inventors: Woo Hong, Seoul (KR); Sangik Lee, Seoul (KR); Jongho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 597 days.

(21) Appl. No.: 17/597,930

(22) PCT Filed: Jul. 24, 2020

(86) PCT No.: PCT/KR2020/009748
§ 371 (c)(1),
(2) Date: May 16, 2022

(87) PCT Pub. No.: WO2021/020812
PCT Pub. Date: Feb. 4, 2021

(65) Prior Publication Data

US 2023/0180981 A1 Jun. 15, 2023

(30) Foreign Application Priority Data

Jul. 30, 2019 (KR) ..... 10-2019-0092683

(51) Int. Cl.
*A47L 9/04* (2006.01)
*A47L 9/28* (2006.01)

(52) U.S. Cl.
CPC ..... *A47L 9/0477* (2013.01); *A47L 9/0494* (2013.01); *A47L 9/2805* (2013.01); *A47L 9/2847* (2013.01); *A47L 2201/04* (2013.01)

(58) Field of Classification Search
CPC .... A47L 9/0477; A47L 9/0483; A47L 9/0494; A47L 9/0633; A47L 9/064; A47L 9/0653;
(Continued)

(56) References Cited

U.S. PATENT DOCUMENTS 6,023,807 A 2/2000 Beissner
2006/0070209 A1 4/2006 Fischer et al.

FOREIGN PATENT DOCUMENTS

CH 457 357 A 8/1968
CN 107252276 A 10/2017
(Continued)

OTHER PUBLICATIONS

English translation of KR 20180027037A (Year: 2018).*
International Search Report dated Oct. 27, 2020, for PCT/KR2020/009748 (9 pages).

*Primary Examiner* — David S Posigian
*Assistant Examiner* — Sukwoo James Chang
(74) *Attorney, Agent, or Firm* — Birch, Stewart, Kolasch & Birch, LLP

(57) ABSTRACT

Disclosed is a cleaning unit comprising a variable brush portion. The cleaning unit according to an embodiment of the present invention comprises a shaft capable of reciprocating along an axial direction, wherein a first cam protrudes from the outer circumferential surface of the shaft. In addition, the brush portion is arranged on the outer circumferential surface of a body member surrounding the shaft, and the brush portion includes a second cam engaged with the first cam. When the shaft is moved in the axial direction, the first cam pushes the second cam in a radial direction, whereby the brush portion may protrude in the radial direction. That is, as the shaft reciprocates in the axial direction, the length of the brush portion protruding from the outer circumferential surface of the body member may vary.

20 Claims, 21 Drawing Sheets

(58) Field of Classification Search
CPC ..... A47L 9/066; A46B 7/02; A46B 7/023; A46B 7/06; A46B 7/10; A46B 13/005; A46B 13/02
See application file for complete search history.

(56) References Cited

FOREIGN PATENT DOCUMENTS

| | | | | | |
|---|---|---|---|---|---|
| CN | 207666529 | U | | 7/2018 | |
| CN | 208775733 | U | | 4/2019 | |
| FR | 2 928 525 | A1 | | 9/2009 | |
| KR | 2002-0000075 | A | | 1/2002 | |
| KR | 10-2004-0092223 | A | | 11/2004 | |
| KR | 10-0504891 | B1 | | 7/2005 | |
| KR | 10-2013-0143261 | A | | 12/2013 | |
| KR | 10-2014-0140854 | | | 12/2014 | |
| KR | 10-2016-0027782 | A | | 3/2016 | |
| KR | 10-2018-27037 | A | | 3/2018 | |
| KR | 20180027037 | A | * | 3/2018 | ..... A47L 9/04 |
| KR | 10-1851585 | B1 | | 5/2018 | |
| WO | WO 99/60911 | A1 | | 12/1999 | |

* cited by examiner

CLEANING UNIT COMPRISING AGITATOR

CROSS REFERENCE TO RELATED APPLICATIONS

This application is the National Phase of PCT/KR2020/009748 filed on Jul. 24, 2020, which claims priority under 35 U.S.C. § 119 (a) to Patent Application No. 10-2019-0092683 filed in the Republic of Korea on Jul. 30, 2019, all of which are hereby expressly incorporated by reference into the present application.

TECHNICAL FIELD

The present disclosure relates to a cleaning unit, and more particularly, to a cleaning unit having an agitator capable of extending a length of a brush when a cleaner is used on a carpet.

BACKGROUND ART

A cleaner is a device that creates vacuum to suck up dust and dirt, together with air, from floors. The dust and dirt are collected after being separated from the air. The cleaner is equipped with a suction nozzle module that is brought into contact with a surface to be cleaned so as to suck up dust and dirt, together with air, from the surface. In particular, the cleaner is mainly used on floors.

The suction nozzle module includes an agitator to lift or pick up dust and dirt from a surface to be cleaned. A brush or rubber plate is configured to protrude from an outer circumferential surface of the agitator having a cylindrical body. As the agitator rotates, the brush or rubber plate rotates together to lift or pick up dust and dirt from the floor. The dust and dirt are sucked through the suction nozzle module and are then separated from the air to be collected.

However, when a floor surface to be cleaned is a carpet or carpeted floor, the suction nozzle module is apart from the surface of the carpet, and thus, the brush or rubber plate of the agitator does not reach the carpet surface, causing a decrease in cleaning performance.

Therefore, a length extension of the brush or rubber plate of the agitator is required.

An agitator having a length adjustable brush is disclosed in Chinese Patent Publication No. CN 207666529 U (published on Jul. 31, 2018), which is hereby incorporated by reference. In that publication, the agitator is provided with a body part having a plurality of grooves with different heights, and the brush is assembled and disassembled to and from the plurality of grooves, such that the length of the brush can be adjusted in several steps (or a stepwise manner).

However, the brush needs to be separated from one groove to be inserted into another groove whenever floor surface condition or environment changes. There may be some other drawbacks. Dust or dirt accumulated on the agitator gets on hands of a user when disassembling and assembling the brush. Also, it takes an extended amount of time to assemble and disassemble the brush, making it unsuitable for using in automatic cleaning devices such as a robot cleaner.

Both for the hygiene and convenience of the user, a cleaner having a structure that allows a length of a brush or rubber plate of an agitator to be easily adjusted according to a change in floor surface condition should be provided.

Further, in consideration of applicability to automatically operated devices, such as a robot cleaner, a cleaner having a structure that allows a length of a brush or rubber plate of an agitator to be adjusted by recognizing a change in floor surface condition without manipulation of the user should be provided.

DISCLOSURE OF INVENTION

Technical Problem

The present disclosure describes a cleaning unit that can allow a length of a brush to be adjusted in response to a change in floor surface condition. In particular, the present disclosure is directed to providing a cleaning unit having a structure that can easily change a length of a brush without touching dust or dirt while adjusting the length of the brush. Further, the present disclosure is directed to providing a cleaning unit having a structure that can automatically change a length of a brush in response to floor surface conditions.

The present disclosure also describes a cleaning unit having a structure in which a brush is configured to protrude from an outer circumferential surface of a body member as a shaft, which is inserted into a hollow hole of the body member of an agitator along a lengthwise direction of the body member, performs a horizontal motion.

The present disclosure further describes a cleaning unit that can prevent a brush from being separated from an outer circumferential surface of a body member when the brush protrudes from the outer circumferential surface of the body member to be extended by a horizontal motion of a shaft.

The present disclosure further describes a cleaning unit that can prevent a brush from protruding to be extended by a centrifugal force when the brush rotates together with a body member of an agitator.

The present disclosure further describes a cleaning unit that can allow a brush to be returned to its original length when the brush protrudes from an outer circumferential surface of a body member to be extended by a horizontal motion of a shaft.

The present disclosure further describes a cleaning unit that can allow a body member and a shaft to rotate together in an engaged manner when the body member of an agitator rotates together with a brush.

The present disclosure further describes a cleaning unit having a structure that can press one side of a shaft to allow the shaft of an agitator to perform a horizontal motion when the agitator rotates.

The present disclosure further describes a cleaning unit that can prevent a pressing portion of a shaft from being rotated when one side of the shaft is pressed to move horizontally.

The present disclosure further describes a cleaning unit that can guide both sides of a brush to prevent the brush from being shaken when the brush is extended by a horizontal motion of the shaft.

The present disclosure further describes a cleaning unit that can provide a function of extending a length of a brush in a protruding manner due to a horizontal motion of a shaft and a function of preventing the brush from protruding due to a centrifugal force by using a structure in which the shaft and the brush are fitted to each other in addition to a structure in which the brush protrudes to be extended by the horizontal motion of the shaft.

The present disclosure further describes a cleaning unit that can provide a stable restoring force for returning a brush to its original length when the brush is extended by a horizontal motion of a shaft.

The present disclosure further describes a cleaning unit that can easily set a balance between a centrifugal force generated in a brush as an agitator rotates and a restoring force for returning the brush to its original length.

Solution to Problem

According to one aspect of the subject matter described in this application, a cleaning unit includes: a power module; a body part that is connected to the power module to rotate and includes a first through-hole defined in an outer circumferential surface thereof; a shaft that is inserted into a hollow hole of the body part in a lengthwise direction of the body part and performs a reciprocating motion in the body part in the lengthwise direction of the body part; a brush assembly in contact with the outer circumferential surface of the body part along the lengthwise direction of the body part; a first cam extending from a surface in contact with the outer circumferential surface of the body part toward an outer circumferential surface of the shaft through the first through-hole; and a second cam extending from the outer circumferential surface of the shaft toward the first cam. One of the first cam and the second cam is provided at one side thereof with an inclined surface that is inclined along the lengthwise direction of the body part, and a remaining one of the first cam and the second cam presses the inclined surface as the shaft performs the reciprocating motion, so that the brush assembly moves upward and downward in a radial direction of the shaft.

Implementations according to this aspect may include one or more of the following features. For example, the body part may include a body member provided with the first through-hole and having a hollow shape with both ends open, a first end cap that is inserted into the body member from one end of the body member by a predetermined length so as to cover the one end of the body member and accommodates one side of the shaft, and a second end cap that is inserted into the body member from another end of the body member by a predetermined length so as to cover the another end of the body member and accommodates another side of the shaft.

In some implementations, a second through-hole may be defined in the outer circumferential surface of the body part, and the brush assembly may be provided with an elastic member that extends from one side thereof to an inside of the body part through the second through-hole and presses an inner surface of the body member as the brush assembly is raised in the radial direction.

In some implementations, the elastic member may include a first elastic portion extending from the one side of the brush assembly to the inside of the body part through the second through-hole, and a second elastic portion bent from the first elastic portion to extend along a lengthwise direction of the shaft.

In some implementations, a third through-hole may be defined in the outer circumferential surface of the body part, and the brush assembly may be provided with a separation prevention portion that extends from one side thereof to an inside of the body part through the third through-hole and at least partially overlaps the body part in the radial direction of the shaft.

In some implementations, the brush assembly may include a brush, and a brush holder that is in contact with an outer circumferential surface of the body member in a lengthwise direction of the shaft, and has one side thereof provided with the first cam and another side thereof coupled to the brush.

In some implementations, the body member may be provided with an accommodation groove in which the brush holder is accommodated along the lengthwise direction of the shaft. The first end cap may cover one end of the accommodation groove, and the second end cap may cover another end of the accommodation groove. Each of the first end cap and the second end cap may be provided with a radial guide groove, the radial guide grooves formed on a surface of the first end cap that covers the one end of the accommodation groove and a surface that covers the another end of the accommodation groove, respectively. The brush holder may be provided with radial guide protrusions formed on a surface opposite to the first end cap and a surface opposite to the second end cap, respectively. The radial guide protrusions may be inserted into the radial guide grooves, respectively, so as to be guided in the radial direction of the shaft.

In some implementations, a cavity may be recessed from one side of the first end cap toward the body member, and a guide hole may be defined in another side of the first end cap to accommodate an end portion of the one side of the shaft so as to guide the end portion of the one side of the shaft to the cavity.

In some implementations, the end portion of the one side of the shaft and the guide hole may each have a polygonal column shape so as to be engaged with each other.

In some implementations, a power transmission unit having one side connected to the power module and another side inserted into the cavity may be further provided. The cavity and the another side of the power transmission unit may each have a polygonal column shape so as to be engaged with each other.

In some implementations, a cavity may be recessed from one side of the second end cap toward the body member, and a guide hole may be defined in another side of the second end cap to accommodate the another side of the shaft to allow the another side of the shaft to protrude to the cavity, so as to support the another side of the shaft in the radial direction of the shaft.

In some implementations, a shaft accommodating part that includes an accommodation space in which an end portion of the another side of the shaft is accommodated and a bearing that is inserted between an outer circumferential surface of the end portion of the another side of the shaft and an inner circumferential surface of the accommodation space may be further provided.

In some implementations, the first power module may include a first power module configured to rotate the shaft, second power module that is connected to the shaft accommodating part and is configured to press the shaft accommodating part according to operation information, a sensor connected to the first power module to detect a current value of the first power module, and a controller that is configured to calculate the operation information, is electrically connected to the second power module to transmit the calculated operation information to the second power module, and is electrically connected to the sensor to receive the current value of the first power module. The controller may calculate the operation information using the detected current value of the first power module.

In some implementations, the operation information may include first operation information and second operation information. The second power module may be configured to stop upon receiving the first operation information and to press the shaft accommodating part at a predetermined pressure upon receiving the second operation information. The controller may be configured to calculate the first operation information when the detected current value of the first power module is less than a first value and to calculate the second operation information when the detected current value of the first power module is greater than or equal to the first value.

In some implementations, the operation information may include first operation information, second operation information, and third operation information. The second power module may be configured to stop upon receiving the first operation information, press the shaft accommodating part at a first pressure upon receiving the second information, and to press the shaft accommodating part at a second pressure upon receiving the third information. The controller may be configured to calculate the first operation information when the detected current value of the first power module is less than a first value, calculate the second operation information when the detected current value of the first power module is greater than or equal to the first value, and calculate the third operation information when the detected current value of the first power module is greater than or equal to a second value. The second pressure may be greater than the first pressure, and the second value may be greater than the first value.

According to another aspect, a cleaning unit that includes: a power module; a body part that is connected to the power module to rotate and includes a through-hole defined in an outer circumferential surface thereof; a shaft that is inserted into a hollow hole in the body part in a lengthwise direction of the body part and performs a reciprocating motion in the body part in the lengthwise direction of the body part; a brush assembly in contact with the outer circumferential surface of the body part along the lengthwise direction of the body part; a first cam extending from a surface in contact with the outer circumferential surface of the body part toward an outer circumferential surface of the shaft through the through-hole; and a second cam extending from the outer circumferential surface of the shaft toward the first cam. One of the first cam and the second cam includes: a pair of wall portions each having an end portion that is inclined along a lengthwise direction of the shaft; and an inclined portion that connects between the end portions of the pair of wall portions to form an inner space. A remaining one of the first cam and the second cam includes: an insertion portion slidably inserted into the inner space of the inclined portion along one surface of the inclined portion; and a pressing portion in contact with another surface of the inclined portion to press the another surface of the inclined portion. The inclined portion may be pressed as the shaft performs the reciprocating motion, so that the brush assembly moves upward and downward in a radial direction of the shaft.

Implementations according to this aspect may include one or more of the following features. For example, the body part may include a body member provided with the through-hole and having a hollow shape with both ends open; a first end cap that is inserted into the body member from one end of the body member by a predetermined length so as to cover the one end of the body member and accommodates one side of the shaft; and a second end cap that is inserted into the body member from another end of the body member by a predetermined length so as to cover the another end of the body member and accommodates another side of the shaft.

In some implementations, a rim portion that protrudes from the outer circumferential surface of the shaft by a predetermined length in the radial direction of the shaft may be provided at the one side of the shaft. The shaft may include a spring that surrounds the one side of the shaft and has both ends fixedly coupled to the first end cap and the rim portion, respectively.

In some implementations, a cavity may be recessed from one side of the first end cap toward an inside of the body member, and a guide hole may be defined in another side of the first end cap to guide an end portion of the one side of the shaft to the cavity. An inner circumferential surface of the guide hole and an outer circumferential surface of the end portion of the one side of the shaft may be engaged with each other. A stepped surface may be formed between the outer circumferential surface of the end portion of the one side of the shaft that is accommodated in the guide hole and an outer circumferential surface of a connecting portion that is connected to the end portion of the one side of the shaft.

Advantageous Effects of Invention

The implementations of the present disclosure may provide the following benefits.

First, as the present disclosure employs a cam structure capable of converting a horizontal motion of a shaft into a radial motion of a brush assembly, a length of the brush assembly can be adjusted according to floor surface condition. This may allow a brush to strike a surface by extending the length even when a cleaner is used on a carpet where the cleaner is apart from a surface of the carpet. That is, a cleaning performance of the cleaner can be maintained in various floor surface conditions.

In addition, a user can easily adjust the length of the brush without having to touch a dust or dirt during the length adjustment. Accordingly, various types of floors can be cleaned without getting dirt on the user's hands.

According to the present disclosure, when the brush protrudes from an outer circumferential surface of a body part to be extended by the horizontal motion of the shaft, the brush having a separation prevention portion is not excessively extended so as to prevent separation of the outer circumferential surface of the body part, thereby improving stability of a length adjustable structure of the brush.

In addition, as the brush assembly is provided with an elastic member, the brush assembly can be prevented from being extended by a centrifugal force of an agitator before an extension motion of the brush assembly.

Further, as the brush assembly includes the elastic member, the brush in an extended state can be returned to its original position due to an elastic force when pressure applied to the shaft is released.

As a bearing that accommodates and presses the shaft is provided between a shaft accommodating part and the shaft, the length of the brush assembly can be extended by pressing the shaft while the agitator is rotating.

When a first end cap and a second end cap are fittingly coupled to the body member, and the shaft is accommodated in guide holes defined in the first and second end caps, inner circumferential surfaces of the guide holes may be formed in a polygonal column shape, and an outer circumferential surface of the shaft may be formed in a polygonal column shape. Accordingly, the guide holes and the shaft can be rotated together while being engaged with each other.

As guide grooves are formed on the first end cap and the second end cap, respectively, and guide protrusions of the brush assembly are respectively accommodated in the guide grooves to be guided, the brush can be rotated in an accommodation groove without being shaken in a circumferential direction when the brush protrudes to be extended by the horizontal motion of the shaft.

According to the present disclosure, as an assembly structure in which the shaft and the brush are fitted to each other is provided in addition to a structure in which the brush protrudes to be extended by the horizontal motion of the shaft, a function of extending the length of the brush in a protruding manner by the horizontal motion and a function of preventing the brush from being extended by the centrifugal force can be provided.

As a spring that presses the shaft in a lengthwise direction is provided, a stable restoring force that returns the brush to its original length can be provided when the brush protrudes to be extended by the horizontal motion of the shaft.

In addition, the spring that is compressed by a predetermined length is installed before the brush assembly is extended to thereby offset or cancel a centrifugal force generated in the brush assembly. This may allow the brush assembly to be easily extended without the resistance of the spring when the shaft accommodating part presses the shaft. That is, a balance between the centrifugal force generated in the brush and an elastic force that returns the brush to its original length can be easily set.

As the brush assembly is automatically controlled to be extended according to a value of current flowing through a first power module that rotates the agitator, the cleaner, when operated automatically, can be controlled to be operated by extending the length of the brush assembly when cleaning a carpet.

Further, as the brush assembly is automatically controlled to be extended in a stepwise manner according to a value of current flowing through the first power module that rotates the agitator, the cleaner, when operated automatically, can be controlled to be operated by extending the length of the brush assembly in a stepwise manner when cleaning various carpets or carpeted floors.

MODE FOR THE INVENTION

Before discussing an agitator according to implementations of the present disclosure, a related art cleaner to which the agitator can be coupled will be described.

Figure 1:
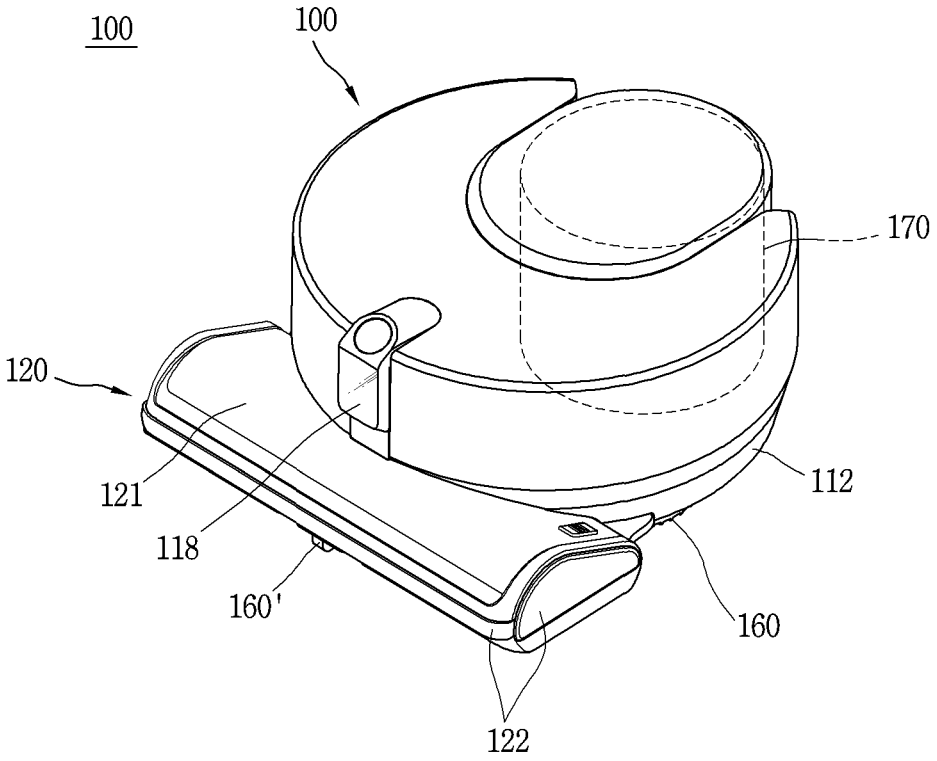
FIG. 1 is a perspective view of a related art robot cleaner.
Figure 2:
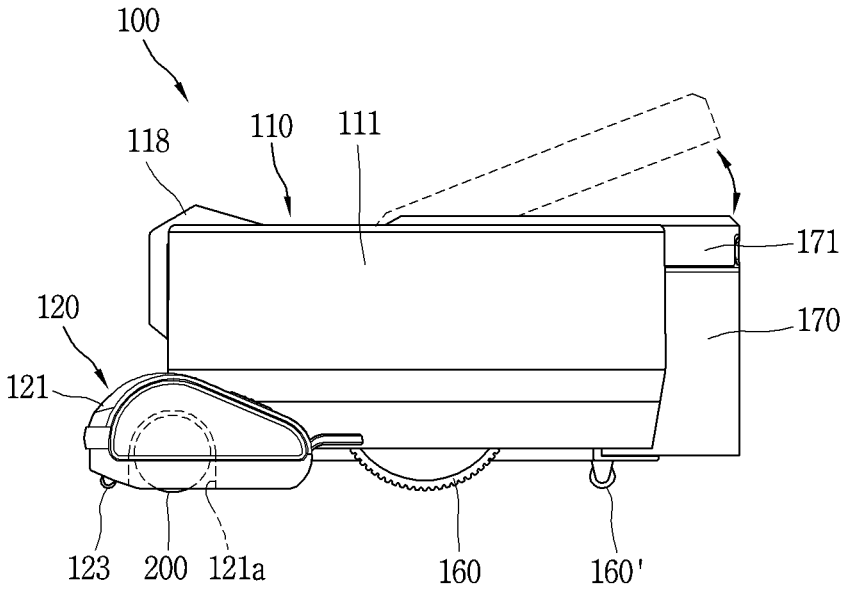
FIG. 2 is a side view of the cleaner in FIG. 1.

FIG. 1 is a perspective view of a related art robot cleaner, and FIG. 2 is a side view of the cleaner illustrated in FIG. 1.

A robot cleaner 100 may be configured to perform not only a function of sucking up dust and dirt from floors, but also a function of mopping the floors. In order for this, the robot cleaner 100 includes a cleaner body 110 and a suction nozzle module 120.

The cleaner body 110 and the suction nozzle module 120 define an outer appearance of the robot cleaner 100. Various components including a controller or control unit (not shown) for controlling the robot cleaner 100 are embedded or installed into the robot cleaner 100. Also, various components required for cleaning a target area (an area to be cleaned) are mounted to the suction nozzle module 120.

An outer appearance of the cleaner body 110 is defined by an outer cover 111 and a base body 112.

The outer cover 111 and the base body 112 are coupled to each other to define the outer appearance of the cleaner body 110. The base body 112 defines a bottom portion of the cleaner body 110 and is configured to accommodate the components of the robot cleaner 100. The outer cover 111 is coupled to an upper portion of the base body 112.

The cleaner body 110 is provided with wheels 160 and 160' to allow the robot cleaner 100 to travel. The wheels 160 and 160' may be provided at a lower portion of the cleaner body 110, or a lower portion of the suction nozzle module 120. The robot cleaner 100 may be moved or rotated forward, backward, leftward, and rightward by the wheels 160 and 160'.

In case the robot cleaner 100 has an autonomous travel (or driving) function, the wheels 160 and 160' may be configured as a wheel module 160 that is rotated by receiving a driving force from a drive motor. Alternatively, when the cleaner body 110 is moved by manipulation of a user, the wheels 160 and 160' may only have a typical function of rolling with respect to the floors.

The cleaner body 110 may include an auxiliary wheel 160'. The auxiliary wheel 160' supports the cleaner body 110 together with the wheel module 160, which may be configured to enable only passive rotation. The auxiliary wheel 160' is configured to assist in traveling the robot cleaner 100 by the wheel module 160.

A dust container 170 is mounted to the rear of the cleaner body 110. The cleaner body 110 may have a partially recessed shape to accommodate the dust container 170 and maintain the circular appearance. The dust container 170 may be provided with at least one of a filter and a cyclone for filtering dust and dirt from the sucked or suctioned air.

The robot cleaner 100 may include a dust container cover 171 for covering the dust container 170. When the dust container cover 171 is disposed to cover an upper surface of the dust container 170, the dust container cover 171 may constrain or lock the dust container 170. Thus, the dust container cover 171 can prevent separation of the dust container 170 from the cleaner body 110.

FIG. 2 illustrates the dust container cover 171 that is hingedly coupled to the cleaner body 110 to be rotatable. The dust container cover 171 may be fixed to the dust container 170 or the cleaner body 110 such that the upper surface of the dust container 170 is kept covered by the dust container 170.

When the robot cleaner 100 has an autonomous travel function, the cleaner body 110 may include a sensing unit 118 for detecting a surrounding environment. The controller (not shown) including a main printed circuit board (PCB) may sense an obstacle or feature, or electronically generate a map of a travel area through the sensing unit 118.

The suction nozzle module 120 is coupled in a manner of protruding from the front of the cleaner body 110 in a protruding shape. An outer appearance of the suction nozzle module 120 is defined by a module mounting housing 121, and an agitator mounting portion 121*a* is provided inside the module mounting housing 121. An agitator 200 is detachably mounted to the agitator mounting portion 121*a*.

A bumper switch 122 that detects a physical collision may be installed at an outside of the suction nozzle module 120.

In the drawing, the bumper switch 122 is provided at the suction nozzle module 120. The bumper switch 122 may be disposed at a front side of the suction nozzle module 120. In some cases, the bumper switch 122 may be provided at both lateral sides of the suction nozzle module 120 in addition to the front side, as illustrated in the drawing.

As illustrated, when the suction nozzle module 120 is disposed in a manner of protruding from the cleaner body 110, the auxiliary wheel 160' may also be provided at the bottom of the suction nozzle module 120 for stable traveling of the robot cleaner 100.

The agitator 200 that is detachably mounted to the agitator mounting portion 121*a* is configured to clean the target area. Dust and dirt in air sucked or suctioned through the agitator 200 are separated by a filter or cyclone provided at the cleaner body 110 or the dust container 170, and are then collected in the dust container 170. The air separated from the dust and dirt is discharged to an outside of the cleaner body 110. An intake passage (not shown) for guiding a flow of air from the agitator mounting portion 121*a* to the dust container 170 may be formed inside the cleaner body 110. In addition, an exhaust passage (not shown) for guiding a flow of air from the dust container 170 to the outside of the cleaner body 110 may be formed inside the cleaner body 110.

FIGS. 1 and 2 schematically illustrate the related art cleaner to which agitators 200 and 300 according to the present disclosure are coupled to be operated, and show positions of the agitators 200 and 300. The agitators 200 and 300 according to the present disclosure may be employed not only in a robot cleaner that is automatically operated, but also in a cleaner that is manipulated by the user.

Hereinafter, a cleaning unit equipped with an agitator having a length adjustable brush according to the present disclosure will be described.

Figure 3:
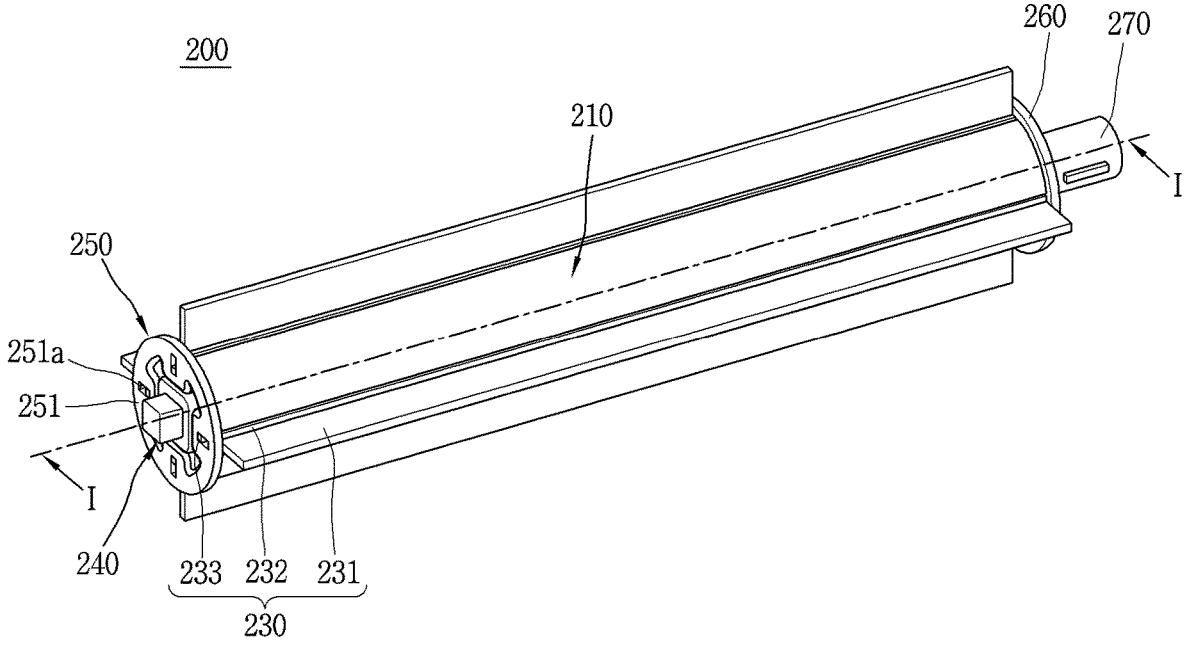
FIG. 3 is a perspective view illustrating an agitator according to one implementation of the present disclosure.

FIG. 3 is a perspective view illustrating an agitator according to one implementation of the present disclosure.

Referring to FIG. 3, the agitator 200 of the present disclosure includes a body member 210, a shaft 220 (see FIG. 4), a brush assembly (or brush portion) 230, a power transmission unit 240, a first end cap 250, a second end cap 260, and a shaft accommodating part 270.

Before describing a configuration (constituting components) of the agitator 200 according to the present disclosure, directions used herein will be defined.

A "lengthwise (or longitudinal) direction" used hereinafter refers to an axial direction of the shaft 220 (see FIG. 4) to be described hereinafter. That is, the "lengthwise direction" is a direction from the first end cap 250 to the second end cap 260, and a direction from the second end cap 260 and to the first end cap 250.

A "radiation direction" used hereinafter refers to a direction of the shortest distance from one point of a central axis from which the shaft 220 (see FIG. 4) described hereinafter extends to another point of an outer circumferential surface of the body member 210 located on a plane perpendicular to the central axis.

A "circumferential direction" used hereinafter refers to a rotational direction when a virtual line perpendicular to the central axis of the shaft 220 (see FIG. 4) described hereinafter is rotated along the central axis.

In addition, "front" used hereinafter refers to a side toward the first end cap 250, and "rear" refers to a side toward the second end cap 260.

The body member 210 may have an inner circumferential surface and an outer circumferential surface and be configured as a hollow hole with both sides open. The shaft 220 (see FIG. 4) to be described hereinafter may be inserted into the hollow hole of the body member 210 in the lengthwise direction, and front and rear sides (or portions) of the shaft 220 may be accommodated in the first end cap 250 and the second end cap 260, respectively.

As the both sides of the shaft 220 (see FIG. 4) are respectively accommodated in the first end cap 250 and the second end cap 260, the shaft 220 may reciprocate in the lengthwise direction. This will be described in detail later.

The first end cap 250 accommodates the front side of the shaft 220 (see FIG. 4) while being fitted to an end of a front side, namely, a front end of the body member 210, so as to cover the front end of the body member 210.

The second end cap 260 accommodates the rear side of the shaft 220 (see FIG. 4) while being fitted to an end of a rear side, namely, a rear end of the body member 210, so as to cover the rear end of the body member 210.

The rear side of the shaft 220 (see FIG. 4) penetrates through the second end cap 260 to be connected to the shaft accommodating part 270.

The body member 210 may be provided with an accommodation groove 211 (see FIG. 4) that is recessed radially inward of the outer circumferential surface thereof along the lengthwise direction by a predetermined length, so as to accommodate the brush assembly 230. The brush assembly 230 may be inserted radially inward of the accommodation groove 211 (see FIG. 4) along the lengthwise direction. The inserted brush assembly 230 may be extended by protruding in the radial direction. This will be described in detail later.

The brush assembly 230 may include a brush holder 232 inserted into the accommodation groove 211 (see FIG. 4) and a brush 231 coupled to the brush holder 232 along the lengthwise direction. Guide protrusions 233 may be formed on both sides of the brush holder 232, respectively.

The guide protrusions 233 are inserted into a first guide groove 251*a* defined in a first end plate 251 and a second guide groove 261*a* defined in a second end plate 261, respectively. Accordingly, the brush assembly 230 may be guided to move upward and downward in the radial direction.

As the guide protrusions 233 are engaged with inner surfaces of the guide grooves 251*a* and 261*a*, respectively, a contact area between the brush holder 232 and the accommodation groove 211 may be reduced when the brush assembly 230 is extended by protruding in the radial direction, thereby preventing the brush holder 232 from being shaken in the circumferential direction. This will be described in detail later.

That is, when the body member 210, the first end cap 250, and the second end cap 260 are defined as a body part, the shaft 220 (see FIG. 4) is accommodated in a hollow hole of the body part in the lengthwise direction, allowing the shaft 220 to perform a reciprocating motion in the body part in the lengthwise direction by a predetermined length or distance.

The brush assembly 230 may be in contact with an outer circumferential surface of the body part in the lengthwise direction so as to rotate together with the body part in the circumferential direction.

Hereinafter, the constituting components of the agitator according to the present disclosure illustrated in FIG. 3 will be described in detail.

Figure 4:
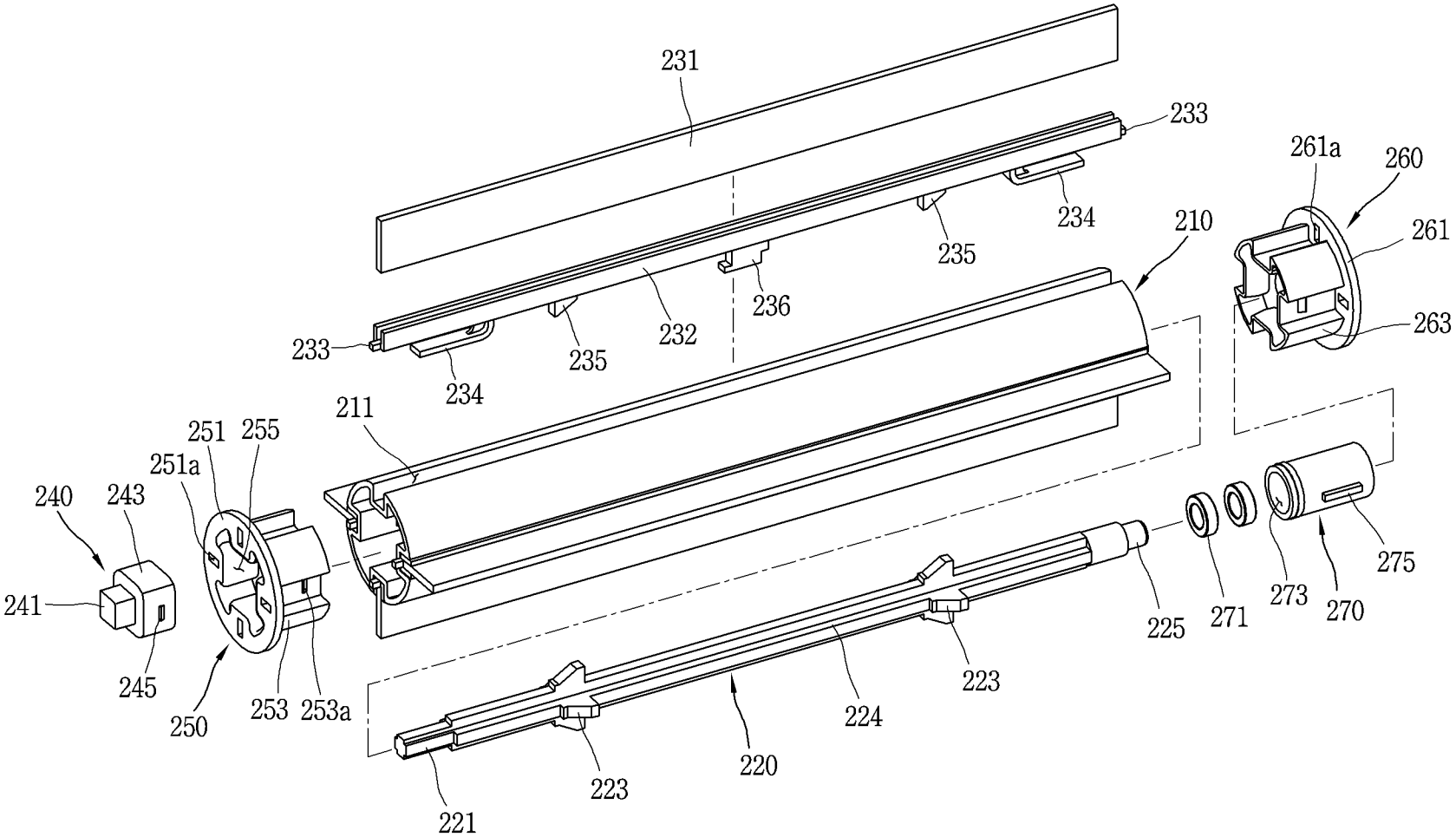
FIG. 4 is an exploded view of the agitator in FIG. 3.

FIG. 4 is an exploded view of the agitator in FIG. 3.

With reference to FIG. 4, the body member 210, the shaft 220, the brush assembly 230, the power transmission unit 240, the first end cap 250, the second end cap 260, and the shaft accommodating part 270 will be described in sequence.

First, the body member 210 according to one implementation of the present disclosure will be described.

The body member 210 may have the inner and outer circumferential surfaces, be configured as a hollow hole with both ends open, and be provided with the accommodation groove 211 recessed radially inward from the outer circumferential surface thereof along the lengthwise direction by a predetermined length.

The accommodation groove 211 may include two surfaces that are opposite to each other and in contact with the brush holder 232 so as to allow the brush holder 232 to be slidingly or slidably inserted, and a bottom surface that supports a surface in an insertion direction of the brush holder 232. A plurality of through-holes 213, 215, and 217 (see FIG. 5) may be formed in the bottom surface.

The shaft 220 may be accommodated in the hollow hole of the body member 210 in the lengthwise direction. The brush assembly 230 may be inserted radially inward of the accommodation groove 211 of the body member 210. The first end cap 250 and the second end cap 260 may be inserted into the both open ends of the body member 210, respectively.

Hereinafter, the shaft 220 according to one implementation of the present disclosure will be described.

The shaft 220 may be accommodated in the hollow hole of the body member 210 in the lengthwise direction, and the both sides thereof may be accommodated in the first end cap 250 and the second end cap 260, respectively, so as to reciprocate in the lengthwise direction.

The shaft 220 has a front end portion 221, a rear end portion 225, and a connecting portion 224 that connects the front end portion 221 and the rear end portion 221. In addition, a second camp 223 may protrude radially outward from an outer circumferential surface of the shaft 220.

The second cam 223 may be provided in plurality to be disposed at the outer circumferential surface of the shaft 220 along the circumferential direction.

As the second cams 223 protrude toward the brush assembly 230, the second cams 223 may be provided at the outer circumferential surface of the shaft 220 along the circumferential direction as many as the number of brush assemblies 230.

In addition, the second cam 223 may be provided in plurality along the lengthwise direction of the shaft 220. The second cam 223 provided at the outer circumferential surface of the shaft 220 may be in contact with a first cam 235 provided at the brush assembly 230.

The front end portion 221 of the shaft 220 may be accommodated in a rear side of the first end cap 250, and the rear end portion 225 of the shaft 220 may be accommodated in a front side of the second end cap 260.

Here, the front end portion 221 and the rear end portion 225 of the shaft 220, and the connecting portion 224 that connects the two end portions may have different shapes.

In some implementations, the front end portion 221 of the shaft 220 may be formed in a polygonal column shape. Accordingly, when the body member 210, the first end cap 250, and the second end cap 260 rotate, an outer circumferential surface of the front end portion 221 having the polygonal column shape may rotate together with the first end cap 250 in an engaged manner without being loose.

Here, the polygonal column shape may not necessarily include only straight lines, and include all different shapes with a combination of a straight line and a curved line, in addition to a cylindrical shape.

In addition, the front end portion 221 of the shaft 220 may be formed such that a length (insertion length) of the front end portion 221 of the shaft 220 that is inserted into the first end cap 250 is limited. In some implementations, at least a portion (or part) of the outer circumferential surface of the front end portion 221 of the shaft 220 may be radially stepped with respect to an outer circumferential surface of the connecting portion 224. That is, when the front end portion 221 of the shaft 220 is inserted and accommodated in the first end cap 250, the insertion length of the front end portion 221 may be limited by the step between the front end portion 221 and the connecting portion 224 of the shaft 220.

The rear end portion 225 of the shaft 220 may be formed in a cylindrical shape. The rear end portion 225 of the shaft 220 having the cylindrical shape is accommodated in the shaft accommodating part 270 by penetrating through the second end cap 260. Accordingly, the shaft accommodating part 270 may remain in a non-rotational state when the body member 210, the first end cap 250, the second end cap 260, the shaft 220, and the brush assembly 230 rotate together.

To this end, a bearing 271 may be provided between an outer circumferential surface of the rear end portion 225 of the shaft 220 and the shaft accommodating part 270 in which the outer circumferential surface of the rear end portion 225 is accommodated.

In addition, the rear end portion 225 of the shaft 220 may be formed such that a length (insertion length) of the rear end portion 225 of the shaft 220 that is inserted into the shaft accommodating part 270 by penetrating through the second end cap 250 is limited. In some implementations, at least a portion of the outer circumferential surface of the rear end portion 225 of the shaft 220 may be radially stepped with respect to the outer circumferential surface of the connecting portion 224. That is, when the rear end portion 225 of the shaft 220 is inserted and accommodated in the second end cap 260, the insertion length of the rear end portion 225 may be limited by the step between the rear end portion 225 of the shaft 220 and the connecting portion 224. In other words, when the rear end portion 225 of the shaft 220 is inserted into the shaft accommodating part 270, a stepped surface between the rear end portion 225 of the shaft 220 and the connecting portion 224 presses a front surface of the bearing 271 to thereby limit the insertion length of the rear end portion 225.

The connecting portion 224 of the shaft 220 may be formed in a cylindrical shape or polygonal column shape. In some implementations, the polygonal column shape may not necessarily include only straight lines and include all different shapes with a combination of a straight line and a curved line, in addition to a cylindrical shape. However, in order to for the shaft 220 to be efficiently rotated, a central axis of rotation should coincide with the center of mass.

Hereinafter, the brush assembly 230 according to one implementation of the present disclosure will be described.

The brush assembly 230 is inserted into the accommodation groove 211 recessed radially inward from the outer circumferential surface of the body member 210 along the lengthwise direction by a predetermined length. As the shaft 220 reciprocates in the lengthwise direction, the brush assembly 230 may move upward and downward in the radial direction.

The brush assembly 230 may include the brush 231, the brush holder 232 that accommodates the brush 231 to be coupled to each other. In some implementations, the brush 231 and the brush holder 232 may have substantially the same length in the lengthwise direction. As the body member 210 rotates, and the brush holder 232 that is coupled to the body member 210 rotates, the brush 231 may also rotate together. The brush 231 may have a predetermined radial length, and a radial outer end portion of the brush 231 may lift or pick up dust or dirt from the floor.

The brush holder 232 may include a bottom surface that is in contact with the brush 231 and connects two walls opposite to each other and a radial inner end portion of the two walls. That is, the two walls of the brush holder 232 may be brought into contact with the two opposite walls of the accommodation groove 211 to be inserted, and the bottom surface of the brush holder 232 may be in contact with the bottom surface of the accommodation groove 211.

The guide protrusions 233 may be formed on front and rear sides of the bottom surface of the brush holder 232, respectively. The guide protrusions 233 may be inserted into the first guide groove 251*a* defined in the first end plate 251 of the first end cap 250 and the second guide groove 261*a* defined in the second end plate 261 of the second end cap 260, respectively. The guide protrusions 233 may be guided in the radial direction by the first and second guide grooves 251*a* and 261*a*.

The bottom surface of the brush holder 232 may be in contact with the bottom surface of the accommodation groove 211, and an elastic member 234, the first camp 235, and a separation prevention portion 236 may be provided at the bottom surface of the brush holder 232 in positions corresponding to the plurality of through-holes 213, 215, and 217.

The elastic member 234, the first cam 235, and the separation prevention portion 236 may extend from the bottom surface of the brush holder 232 toward the outer circumferential surface of the shaft 220.

While the brush holder 232 is inserted into the accommodation groove 211, the elastic member 234 may extend radially inward from the bottom surface of the brush holder 232 by a predetermined length through the second through-hole 213 (see FIG. 5) and be bent to extend along the lengthwise direction. A centrifugal force generated when the agitator 200 rotates prevents the brush assembly 230 from being extended and generates a restoring force to restore the brush assembly 230 back to its original position when extended. This will be described in detail later.

The elastic member 234 may be provided in plurality along the bottom surface of the brush holder 232. In some implementations, the elastic members 234 may be respectively spaced apart from the front and rear sides of the brush holder 232 by the same length.

The first cam 235 may extend from the bottom surface of the brush holder 232 toward the outer circumferential surface of the shaft 220.

While the brush holder 232 is inserted into the accommodation groove 211, the first cam 235 may extend radially inward from the bottom surface of the brush holder 232 by a predetermined length through the first through-hole 215 (see FIG. 5), so as to be in contact with the second cam 223 of the shaft 220. When the shaft 220 moves toward the first end cap 250 in the lengthwise direction, the first cam 235 may be pressed by the second cam 223 provided at the shaft 220 to be raised radially outward. This will be described in detail later.

As the second cam 223 of the shaft 220 is provided in plurality along the lengthwise direction, a plurality of first cams 235 may be provided in positions corresponding to the second cams 223.

The separation prevention portion 236 may extend from the bottom surface of the brush holder 232 toward the outer circumferential surface of the shaft 220.

While the brush holder 232 is inserted into the accommodation groove 211, the separation prevention portion 236 may extend radially inward from the bottom surface of the brush holder 232 through the third through-hole 217 (see FIG. 5) by a predetermined length. In a state that the brush holder 232 is inserted into the accommodation groove 211, at least a portion of the separation prevention portion 236 may overlap the body member 210 in the radial direction. When the brush holder 232 is raised radially outward as the shaft 220 moves toward the first end cap 250 in the lengthwise direction, the portion of the separation prevention portion 236 that radially overlaps the body member 210 presses an inner surface of the body member 210, thereby preventing the brush holder 232 from moving radially outward from the accommodation groove 211. This will be described in detail later.

Hereinafter, the power transmission unit 240 according to one implementation of the present disclosure will be described.

The power transmission unit 240 may include a motor connecting (or connection) portion 241 having a front side connected to a first power module 13*a* (see FIG. 14), and an agitator connecting portion 243. The motor connecting portion 241 may be connected to the first power module 13*a* (see FIG. 14) to be rotated by the first power module 13*a* (see FIG. 14). As the motor connecting portion 241 rotates, the agitator connecting portion 243 that is joined to a rear side of the motor connecting portion 241 may be rotated. The agitator connecting portion 243 may be inserted by being engaged with an inner circumferential surface of a first cavity 255 formed on a front side of the first end cap 250 to cause the first end cap 250 to rotate, allowing the agitator 200 to be rotated.

The motor connecting portion 241 of the power transmission unit 240 may have a polygonal column shape so as to rotate by being engaged with the first power module 13*a* (see FIG. 14) without idling. The agitator connecting portion 243 provided at the rear side of the motor connecting portion 241 may have a polygonal column shape. An outer circumferential surface of the agitator connecting portion 243 may be inserted into the first cavity 255 that is recessed from the front side to the rear side of the first end cap 250.

The outer circumferential surface of the agitator connecting portion 243 may be inserted by being at least partially engaged with the inner circumferential surface of the first cavity 255. This may allow a rotational force of the first power module 13*a* (see FIG. 14) to be transmitted to the first end cap 250. That is, the agitator connecting portion 243 may have the polygonal column shape that is engaged with at least a portion of the inner circumferential surface of the first cavity 255.

A coupling protrusion 245 may be formed on the outer circumferential surface of the agitator connecting portion 243. When the agitator connecting portion 243 is inserted into the first cavity 255, the coupling protrusion 245 may be inserted into a first coupling groove 253*a* formed in a first fitting portion 253 defining the first cavity 255. Accordingly, the agitator connecting portion 243 can be securely coupled to the first cavity 255 without being separated therefrom, allowing the power transmission unit 240 and the first end cap 250 to be coupled to each other.

Hereinafter, the first end cap 250 according to one implementation of the present disclosure will be described.

The first end cap 250 may accommodate the front end portion 221 of the shaft 220 so as to guide the shaft 220 to reciprocate in the lengthwise direction by a predetermined distance (or length). The first end cap 250 may cover one end of the body member 210 and one end of the accommodation groove 211.

The first end cap 250 may include the first fitting portion 253 that is engagingly fitted into the inner circumferential surface of the body member 210 so as to cover the one end of the body member 210, and the first end plate 251 that extends radially outward from a front side of the first fitting portion 253 so as to cover the one end of the accommodation groove 211.

The first fitting portion 253 may be configured as an outer wall that is engagingly fitted into the inner circumferential surface of the body member 210 along the circumferential direction and a bottom surface that is formed along the outer wall to cover the one end of the body member 210. The first cavity 255 is defined by the outer wall and the bottom surface.

A first guide hole 257 (see FIG. 6A) that accommodates the front end portion 221 of the shaft 220 to guide it to the first cavity 255 is defined in the bottom surface of the first fitting portion 253. A reciprocating motion of the shaft 220 in the lengthwise direction is guided by the first guide hole 257 (see FIG. 6A).

The first guide hole 257 (see FIG. 6A) may be engaged with the outer circumferential surface of the front end portion 221 of the shaft 220, so as to transmit a rotational force of the first end cap 250 to the front end portion 221 of the shaft 220. This will be described in detail later.

The inner circumferential surface of the first cavity 255 may be engaged with at least a portion of the outer circumferential surface of the agitator connecting portion 243 of the power transmission unit 240.

The outer wall of the first fitting portion 253 may extend from the bottom surface of the first fitting portion 253 in a rear or rearward direction of the body member 210 by a predetermined length. When the brush assembly 230 is raised in the radial direction, an end portion of the elastic member 234 of the brush holder 232 may press a portion of the first fitting portion 253 extending to the rearward direction of the body member 210 to thereby generate a restoring force of the brush assembly 230. This will be described in detail later.

The first guide groove 251*a* may be formed in a portion (or area) that is in contact with one open end of the accommodation groove 211 to accommodate the guide protrusion 233 of the brush holder 232.

The first guide groove 251*a* may be recessed or penetrate from a rear side to front side of the first end plate 251 along the radial direction by a predetermined length. An inner circumferential surface of the first guide groove 251*a* may be partially engaged with an outer circumferential surface of the brush holder 232, thereby preventing the brush holder 232 from being shaken in the circumferential direction.

Hereinafter, the second end cap 260 according to one implementation of the present disclosure will be described.

The second end cap 260 may accommodate the rear side of the shaft 220 so as to guide the shaft 220 to reciprocate in the lengthwise direction by a predetermined distance (or length), and cover another end of the body member 210 and another end of the accommodation groove 211.

The second end cap 260 may include a second fitting portion 263 that is engagingly fitted into the inner circumferential surface of the body member 210 so as to cover a rear end portion of the body member 210, and the second end plate 261 that extends radially outward from a rear side of the second fitting portion 263 so as to cover a rear end portion of the accommodation groove 211.

The second fitting portion 263 may be configured as an outer wall that is engagingly fitted into the inner circumferential surface of the body member 210 along the circumferential direction and a bottom surface that covers the another end of the body member 210. A second cavity 265 that is recessed from a rear side to front side of the second end cap 260 is defined by the outer wall and the bottom surface.

A second guide hole 267 (see FIG. 6A) that accommodates a rear side of the connecting portion 224 of the shaft 220 and guides the shaft 220 to the second cavity 265 of the second end cap 260 is defined in the bottom surface of the second fitting portion 263. A reciprocating motion of the shaft 220 in the lengthwise direction is guided by the second guide hole 267 (see FIG. 6A).

The second guide hole 267 (see FIG. 6A) may be engaged with an outer circumferential surface of the rear side of the connecting portion 224 of the shaft 220, so as to transmit a rotational force of the second end cap 250 to the rear side of the connecting portion 224 of the shaft 220.

When the shaft 220 moves in a direction toward the first end cap 250, the second cavity 265 accommodates the shaft accommodating part 270 in which the rear end portion 225 of the shaft 220 is accommodated.

When the second end cap 260 rotates, an inner circumferential surface of the second cavity 265 may not be brought into contact with the shaft accommodating part 270 that is accommodated in the second cavity 265.

The second guide groove 261*a* is formed in a portion (or area) that is in contact with another open end of the accommodation groove 211 to accommodate the guide protrusion 233 of the brush holder 232.

The second guide groove 261*a* may be recessed or penetrate along the radial direction by a predetermined length. An inner circumferential surface of the second guide groove 261*a* may be partially engaged with an outer circumferential surface of the guide protrusion 233, thereby preventing the brush holder 232 from being shaken in the circumferential direction.

Hereinafter, the shaft accommodating part 270 according to one implementation of the present disclosure will be described.

The shaft accommodating part 270 may accommodate the rear end portion 225 of the shaft 220 and press the rear end portion 225 of the shaft 220 forward or in a front or forward direction of the shaft 220 to move the shaft 220 in the lengthwise direction.

An accommodation space 273 in which the rear end portion 225 of the shaft 220 is accommodated may be formed in a front side of the shaft accommodating part 270. The accommodation space 273 may have a cylindrical shape to accommodate the rear end portion 225 of the shaft 220 with a cylindrical shape. The bearing 271 is inserted between an inner circumferential surface of the accommodation space 273 and the outer circumferential surface of the rear end portion 225 of the shaft 220 to radially support the rear end portion 225 of the shaft 220 while rotating. Accordingly, the shaft accommodating part 270 may be fixed without being rotated together with the shaft 220.

A protruding portion protrudes radially inward from an inner circumferential surface of the shaft accommodating part 270 along the circumferential direction. The protruding portion may support the bearing 271 or the rear end portion 225 of the shaft 220 in the lengthwise direction.

Figure 5:
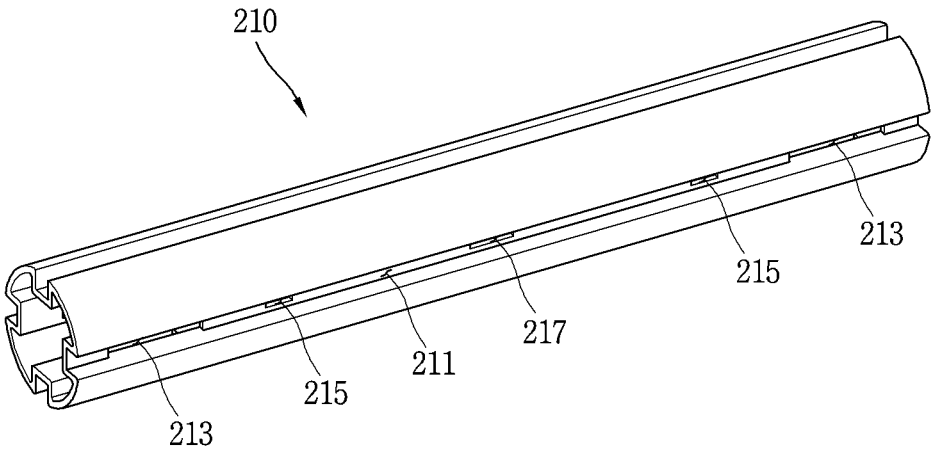
FIG. 5 is a perspective view illustrating a body part of the agitator in FIG. 4.

FIG. 5 is a perspective view of the body member 210 according to one implementation of the present disclosure.

FIG. 5 illustrates the body member 210 in FIG. 4 at a different angle for showing the plurality of through-holes 213, 215, and 217 formed in the bottom surface of the accommodation groove 211 of the body member 210.

The first through-hole 215, the second through-hole 213, and the third through-hole 217 may be defined in the bottom surface of the accommodation groove 211.

The first, second, and third through-holes 215, 213, and 217 may penetrate from the outer circumferential surface to the inner circumferential surface of the body member 210. The first cam 235 may be inserted into the first through-hole 215, the elastic member 234 may be inserted into the second through-hole 213, and the separation prevention portion 236 may be inserted into the third through-hole 217.

The first, second, and third through-holes 215, 213, and 217 may each be provided in plurality along the lengthwise direction of the body member 210. When provided in plurality, the first, second, and third through-holes 215, 213, and 217 may be disposed at the front and rear sides of the body member 210 with the same distance apart. In some implementations, when two first through-holes 215 into which the first cams 235 are inserted are provided, the two first through-holes 215 may be spaced apart from the front side and the rear side of the body member 210, respectively, by the same distance. In some implementations, when three first through-holes 215 into which the first cams 235 are inserted are provided, one may be located at the middle of the body member 210 in the lengthwise direction, and the other two may be spaced apart from the front side and the rear side of the body member 210, respectively, by the same distance. That is, they may be symmetric with respect to an intermediate point of the body member 210 in the lengthwise direction. Accordingly, when the brush assembly 230 is raised in the radial direction as the first cams 235 are pressed by the second cams 223, the front side and the rear side of the brush assembly 230 can be evenly or uniformly pressed to move upward.

The accommodation groove 211 that accommodates the brush assembly 230 and is recessed from the outer circumferential surface of the body member 210 along the lengthwise direction may be provided in plurality along the circumferential direction of the body member 210. The first, second, and third through-holes 215, 213, and 217 defined in the bottom surface of the accommodation groove 211 may also be provided in plurality along the circumferential direction.

Hereinafter, a process in which a length of the brush assembly 230 of the agitator 200 according to one implementation of the present disclosure is extended will be described with reference to FIGS. 6A and 6B.

Figure 6A:
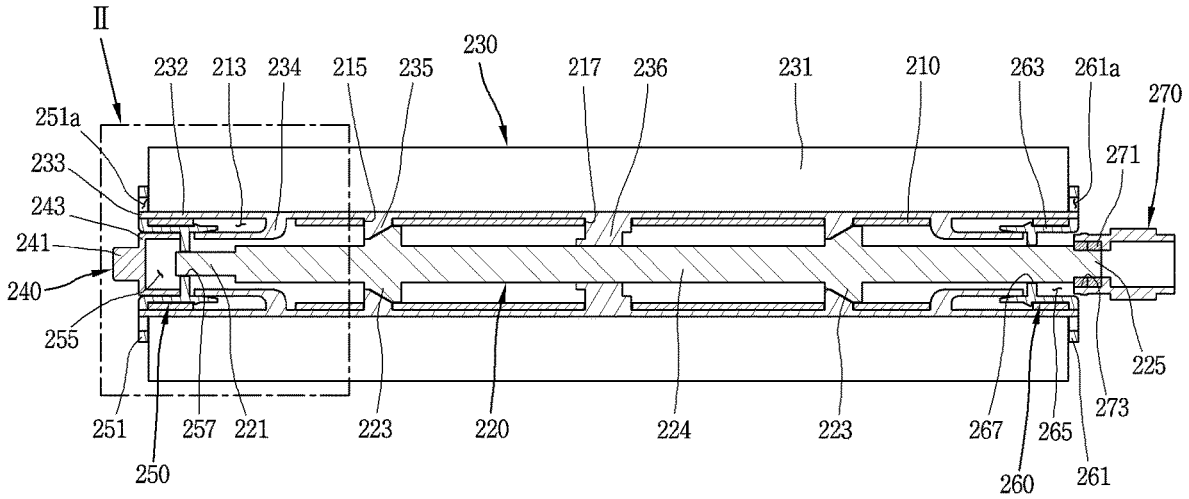
FIG. 6A is a cross-sectional view taken along line "I-I" of the agitator in FIG. 3.
Figure 6B:
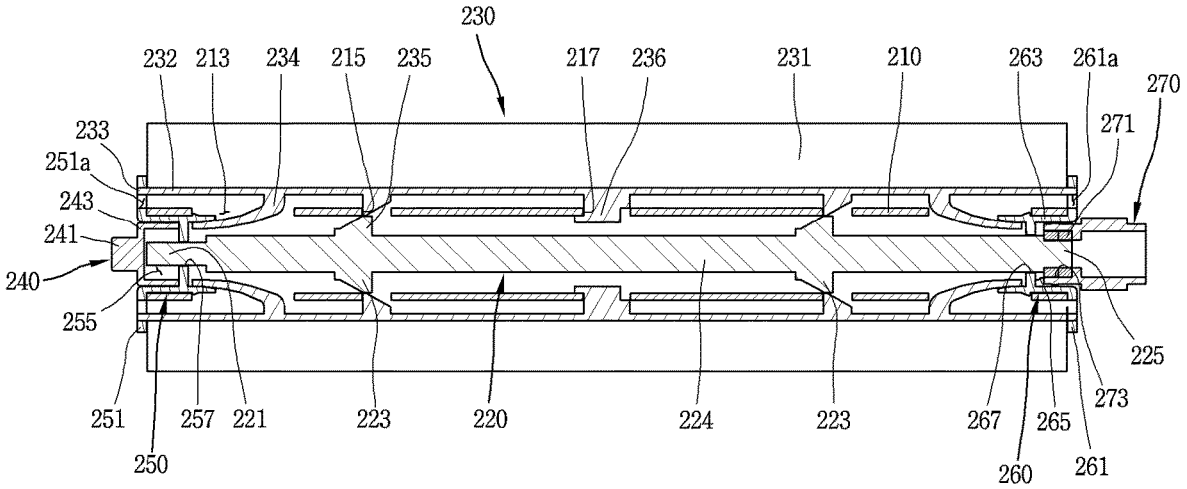
FIG. 6B is a cross-sectional view illustrating an extended state of a brush assembly of the agitator in FIG. 6A.

FIG. 6A illustrates a state before the brush assembly 230 of the agitator 200 is extended, and FIG. 6B illustrates a state in which the brush assembly 230 of the agitator 200 is extended.

FIG. 6A is a cross-sectional view taken along line "I-I" of the agitator 200 in FIG. 3.

In FIG. 6A, a state before the shaft 220 moves in a direction toward the first end cap 250 along the lengthwise direction is illustrated.

The shaft 220 is accommodated in the hollow hole of the body member 210 along the lengthwise direction. The first end cap 250 may accommodate the front end portion 221 of the shaft 220 and cover one end of the body member 210, and the second end cap 260 may accommodate the rear end portion 225 of the shaft 220 and cover another end of the body member 210.

At least a portion of the outer circumferential surface of the front end portion 221 of the shaft 220 may be engaged with an inner circumferential surface of the guide hole 257 defined in the first fitting portion 253 of the first end cap 250 to be accommodated in the first guide hole 257. The front end portion 221 of the shaft 220 is exposed to the first cavity 255 of the first end cap 250 by penetrating through the first guide hole 257.

At least a portion of the outer circumferential surface of the connecting portion 224 of the shaft 220 may be accommodated in the second guide hole 267 defined in the second fitting portion 263 of the second end cap 260. The rear side of the connecting portion 224 of the shaft 220 penetrates through the second guide hole 267 to be exposed to the second cavity 265 of the second end cap 260.

The rear end portion 225 of the shaft 220 is accommodated in the accommodation space 273 of the shaft accommodating part 270. When the brush assembly 230 is extended, the shaft accommodating part 270 presses the rear end portion 225 of the shaft 220 to be accommodated in the second cavity 265 of the second end cap 260 together with the rear end portion 225 of the shaft 220.

That is, in order to extend the length of the brush assembly 230, a pressing module that is connected to the shaft accommodating part 270 presses the shaft accommodating part 270, and the shaft accommodating part 270 presses the rear end portion 225 of the shaft 220. Then, the shaft 220 is guided by the first guide hole 257 and the second guide hole 267 to thereby move in a forward direction of the body member 210 along the lengthwise direction. As the front end portion 221 of the shaft 220 protrudes in the forward direction the body member 210 in the first cavity 255, and a stepped surface that connects the connecting portion 224 and the front end portion 221 of the shaft 220 presses the first end cap 250, movement of the shaft 220 may be stopped.

In some implementations, movement of the shaft 220 may be stopped as the front end portion 221 of the shaft 220 moved is pressed by being brought into contact with an inner surface of the agitator connecting portion 243 of the power transmission unit 240 that is inserted into the first cavity 255.

In some implementations, movement of the shaft 220 may be stopped by setting a length by which the shaft accommodating part 270 presses the shaft 220 to move.

The accommodation groove 211 formed along the lengthwise direction may be provided in plurality on the outer circumferential surface of the body member 210 along the circumferential direction. The first, second, and third through-holes 215, 213, and 217 may be defined in the bottom surface of the accommodation groove 211 by penetrating from the outer circumferential surface of the body member 210 to the outer circumferential surface of the shaft 220.

The brush holder 232 of the brush assembly 230 may be inserted into the accommodation groove 211. The first cam 235, the elastic member 234, and the separation prevention portion 236 may extend from the bottom surface of the brush holder 232 corresponding to positions of the first, second, and third through-holes 215, 213, and 217.

The first cam 235 may extend toward the outer circumferential surface of the shaft 220 through the first through-hole 215, so as to be in contact with the second cam 223 extending from the outer circumferential surface of the shaft 220 toward the first cam 235.

Accordingly, when the second cam 223 moves in the forward direction of the body member 210 along the lengthwise direction, the second cam 223 may press the first cam 235 through a contact surface with the first cam 235. The contact surface between the second cam 223 and the first cam 235 may be configured such that the first cam 235 is raised in the radial direction using a force that the second cam 223 presses the first cam 235 in the lengthwise direction. In some implementations, the first cam 235 and the second cam 223 may each have an inclined end surface to be engaged with each other. That is, an end portion of the first cam 235 extending toward the second cam 223 is inclined at a first inclination (or slope) along the lengthwise direction, and an end portion of the second cam 223 extending toward the first cam 235 is inclined at a second inclination along the lengthwise direction. The first and second inclinations may be substantially the same to thereby allow the first cam 235 and the second cam 223 to be engaged with each other.

Dynamics between the second cam 223 and the first cam 235 when the inclined surface of the second cam 223 is engaged with the inclined surface of the first cam 235 are as follows.

As the elastic member 234 presses the body member 210 before the shaft 220 moves in the lengthwise direction, the first cam 235 presses the second cam 223, and the inclined surface of the second cam 223 moves in the lengthwise direction to press the inclined surface of the first cam 235. Accordingly, a force that the first cam 235 presses the second cam 223 can be offset, and a radial motion of the second cam 235 can be guided or induced.

When a contact area between the first cam 235 and the second cam 223 is small, pressure may be excessively generated in the contact area. As the pressure formed in the contact area increases, the magnitude of force applied per unit area increases and a frictional force is increased accordingly. This may cause a durability problem. Thus, a sufficient contact area between the inclined surface of the first cam 235 and the inclined surface of the second cam 223 is required to reduce the frictional force.

Kinematics of cams to be in contact using an inclination is well known in the art, so details thereof will be omitted.

In addition, when the inclined surface of the second cam 223 presses the first cam 235, not only a force that causes the first cam 235 to be raised in the radial direction, but also a force that causes the first camp 235 to move in the lengthwise direction is acted. Thus, contact surfaces of the first cam 235 and the first through-hole 215 may be engaged with each other to offset the force of moving the first cam 235 in the lengthwise direction by the second camp 223.

That is, a longitudinal length of the first through-hole 215 may be substantially equal to a longitudinal length of the first cam 235.

The elastic member 234 may extend toward the outer circumferential surface of the shaft 220 through the second through-hole 213. The elastic member 234 may radially extend toward the outer circumferential surface of the shaft 220 by a predetermined length and be bent to extend along the lengthwise direction. That is, the elastic member 234 may include a radially extended portion and a longitudinally extended portion that is bent therefrom.

In a state before the shaft 220 is pressed by the shaft accommodating part 270, an end portion of the longitudinally extended portion of the elastic member 234 may be brought into the inner circumferential surface of the body member 210 or the first fitting portion 253 of the first end cap 250. The end portion of the longitudinally extended portion of the elastic member 234 may press the inner circumferential surface of the body member 210 or the first fitting portion 253 radially outward while being in contact with the inner circumferential surface of the body member 210 or the fitting portion 253 of the first end cap 250. That is, an elastic force of the elastic member 234 may be applied radially outward when the longitudinally extended portion of the elastic member 234 is bent by being spaced apart radially inward from the brush holder 232.

In other words, the longitudinally extended portion of the elastic member 234 may be brought into contact with the inner circumferential surface of the body member 210 or the first fitting portion 253 of the body member 210 while being spaced apart from the brush holder 232 by a predetermined length, such that an elastic force is applied radially outward to the inner surface of the body member 210 or the first fitting portion 253. As the inner surface of the body member 210 or the first fitting portion 253 is fixed, a reaction force is applied to the end portion of the longitudinally extended portion of the elastic member 234 by the inner surface of the body member 210 or the first fitting portion 253, allowing the brush assembly 230 to be pressed radially inward.

That is, a centrifugal force applied radially outward to the brush assembly 230 as the agitator 200 rotates is offset by the force that the brush assembly 230 is pressed radially inward by the elastic member 234, thereby preventing the brush assembly 230 from being extended when no pressure is applied to the shaft 220 by the shaft accommodating part 230 while the agitator 200 is rotating.

As the shaft accommodating part 270 is pressed, the shaft 220 is moved its forward direction along the lengthwise direction, and the brush assembly 230 is extended by being raised in the radial direction by the second cam 223. Then, the longitudinally extended portion of the elastic member 234 may be further away from the brush assembly 230 as much as an extended length of the brush assembly 230 to thereby generate a stronger elastic force. Accordingly, when the force applied to the shaft accommodating part 270 is released or disappears, the brush assembly 230 may be returned to be radially inward.

The second through-hole 213 in which the elastic member 234 is inserted may be defined suitable for insertion of the longitudinally extended portion of the elastic member 234. That is, a longitudinal length of the second through-hole 213 may be substantially the same as a longitudinal length of the elastic member 234.

The separation prevention portion 236 may extend radially inward to the outer circumferential surface of the shaft 220 through the third through-hole 217.

In a state that the brush assembly 230 is completely inserted into the accommodation groove 211, a longitudinal length of the separation prevention portion 236 that is accommodated in the third through-hole 217 is almost equal to a length of the third through-hole 217, and a portion of the separation prevention portion 236 located in the body member 210 by penetrating through the third through-hole 217 may radially overlap at least a portion of the inner circumferential surface of the body member 210.

When the brush assembly 230 is extended more than a predetermined length, the portion of the separation prevention portion 236 that radially overlaps the inner circumferential surface of the body member 210 may press the inner circumferential surface of the body member 210, thereby preventing the brush assembly 230 from being extended to a maximum length or separated from the accommodation groove 211.

Hereinafter, an extended state of the brush assembly 230 of the agitator 200 will be described.

FIG. 6B is a cross-sectional view illustrating an extended state of the brush assembly 230 of the agitator 200.

Referring to FIG. 6B, a state in which the brush assembly 230 is extended as the shaft accommodating part 270 presses the rear end portion 225 of the shaft 220 to move the shaft 220 in its forward direction along the lengthwise direction is illustrated.

As the brush assembly 230 is extended, the brush 231 may reach the surface of a carpet. Dust or dirt accumulated on the surface of the carpet may be lifted or picked up to be sucked into the suction nozzle.

As the shaft 220 is moved in its forward direction along the lengthwise direction, the second cam 223 extending from the outer circumferential surface of the connecting portion 224 of the shaft 220 presses the first cam 235, allowing the brush assembly 230 to be raised radially outward.

The front end portion 221 of the shaft 220 is moved in its forward direction along the lengthwise direction until it is brought into contact with the agitator connecting portion 243 that is inserted into the first cavity 255.

Or, the front end portion 221 of the shaft 220 may have a short longitudinal length and be moved until the stepped surface that connects the outer circumferential surface of the connecting portion 224 and the outer circumferential surface of the front end portion 221 of the shaft 220 presses the rear side of the first end cap 250.

As the shaft 220 moves, the brush assembly 230 is raised in the radial direction. Then, the elastic member 234, the first cam 235, and the separation prevention portion 236 of the brush holder 232 are raised in the radial direction.

The separation prevention portion 236 of the brush holder 232 is guided radially outward to move upward along the third through-hole 217, and the portion of the separation prevention portion 236 that radially overlaps the body member 210 presses the inner surface of the body member 210, thereby preventing the brush assembly 230 from being separated from the accommodation groove 211.

The first end plate 251 of the first end cap 250 may cover one end of the accommodation groove 211, and the second end plate 261 of the second end cap 260 may cover another end of the accommodation groove 211. Of the first end plate 251, the first guide groove 251*a* is formed on a surface that is in contact with a front end portion of the accommodation groove 211 in a recessed or penetrating manner by a predetermined length along the radial direction. Of the second end plate 261, the second guide groove 261*a* may be formed on a surface that faces a rear side of the accommodation groove 211 in a recessed or penetrating manner by a predetermined length along the radial direction.

The number of first and second guide grooves 261*a* may be equal to the number of accommodation grooves 211.

As the guide protrusions 233 that protrudes from the both sides of the brush holder 232 are inserted into the first and second guide grooves 251*a* and 261*a*, respectively, and the brush assembly 230 moves upward in the radial direction, the guide protrusions 233 may be guided radially outward in the first and second guide grooves 251*a* and 261*a*. As the brush assembly 230 moves downward in the radial direction, the guide protrusions 233 may be guided radially inward of the first and second guide grooves 251*a* and 261*a*.

The first and second guide grooves 251*a* and 261*a* may include surfaces that are opposite to each other, extend in the circumferential direction, and guide the guide protrusions 233 by being in contact with the outer circumferential surface of the guide protrusions 233.

When the brush assembly 230 is extended in the radial direction, the contact area between the brush holder 232 and the accommodation groove 211 decreases. Then, the brush holder 232 may be shaken in the circumferential direction.

As the guide protrusions 233 are inserted by the outer circumferential surfaces thereof are brought into contact between the opposite surfaces of the first and second guide grooves 251*a* and 261*a*, the guide protrusions 233 may be fixed without moving in the circumferential direction within the first and second guide grooves 251*a* and 261*a*. When the brush assembly 230 is extended, the brush holder 232 may not be shaken in the circumferential direction.

That is, the guide protrusions 233 and the first and second guide grooves 251*a* and 261*a* may allow the brush assembly 230 to be radially extended without being shaken in the circumferential direction.

The elastic member 234 may include the radially extended portion formed radially inward through the second through-hole 213 and the longitudinally extended portion bent from the radially extended portion to extend in the lengthwise direction. The elastic member 234 is provided at each of both sides of the bottom surface of the brush holder 232, such that end portions of the longitudinally extended portions of the elastic members 234 press the first fitting portion 253 and the second fitting portion 263, respectively.

As the brush assembly 230 moves upward in the radial direction, the longitudinally extended portions of the elastic members 234 are bent or curved, and the end portions of the longitudinally extended portions are radially spaced apart from the brush holder 232. The bent longitudinally extended portions press the first end cap 250 and the second end cap 260, respectively, due to restoring forces of the bent longitudinally extended portions. As the end portions of the longitudinally extended portions are fixed, the end portions of the longitudinally extended portions pull the radially extended portions radially inward, and thus, the brush assembly 230 is pulled radially inward.

Accordingly, the inclined surface of the first cam 235 extending from the brush holder 232 can press the inclined surface of the second cam 223 with a stronger force than before the brush assembly 230 is extended, allowing the shaft accommodating part 270 to be returned to its original position when the force pressing the shaft 220 is released.

That is, when the force of pressing the shaft 220 by the shaft accommodating part 270 is released, the inclined surface of the first cam 235 presses the inclined surface of the second cam 223 by the elastic member 234 to thereby move the shaft 220 in its rearward direction.

Figure 7:
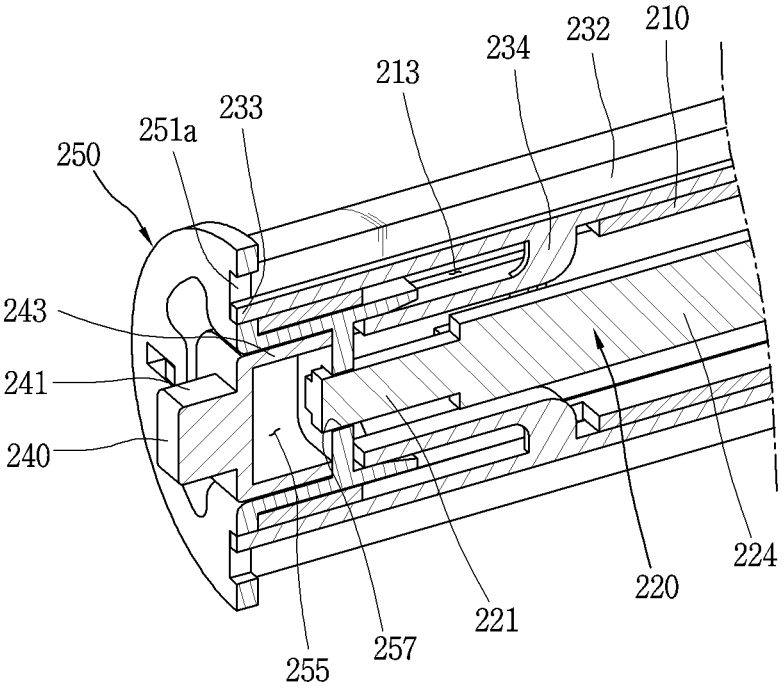
FIG. 7 is a cross-sectional perspective view illustrating a portion "II" of the agitator in FIG. 6A.

FIG. 7 is a cross-sectional perspective view illustrating a portion "II" of the agitator 200 in FIG. 6A for showing a front coupling structure of the agitator 200. For the sake of convenience, some components are omitted.

An inner cavity that is open toward the first guide hole 257 of the first end cap 250 may be defined in the agitator connecting portion 243 of the power transmission unit 240 that is inserted into the first cavity 255. The outer circumferential surface of the agitator connecting portion 243 may be formed in a polygonal column shape to be engaged with the inner circumferential surface of the first cavity 255. Accordingly, when the power transmission unit 240 is rotated by the first power module 13*a* (see FIG. 14), a rotational force can be transmitted to the first end cap 250 by the agitator connecting portion 243, and the body member 210 can be rotated as the first end cap 250 rotates.

The first guide hole 257 allows the front end portion 221 of the shaft 220 to be introduced into the inner cavity defined in the agitator connecting portion 243. The front end portion 221 of the shaft 220 reciprocates in the inner cavity of the agitator connecting portion 243 in the lengthwise direction.

An inner circumferential surface of the first guide hole 257 may have a polygonal column shape, and the outer circumferential surface of the front end portion 221 of the shaft 220 may also have a polygonal column shape corresponding thereto. As the inner circumferential surface of the first guide hole 257 is engaged with the outer circumferential surface of the front end portion 221 of the shaft 220, the shaft 220 may rotate together with the first end cap 250 without idling.

The accommodation groove 211 may be formed on the outer circumferential surface of the body member 210, and the second through-hole 213 may be defined in the bottom surface of the accommodation groove 211. The longitudinal length of the second through-hole 213 may be less (or shorter) than a length of the longitudinally extended portion of the elastic member 234. Accordingly, at least a portion of the longitudinally extended portion of the elastic member 234 can radially overlap the inner surface of the body member 210, and press the inner surface of the body member 210 when the brush holder 232 is moved upward.

In some implementations, at least a portion of the longitudinally extended portion of the elastic member 234 may radially overlap the first end cap 250. Accordingly, the at least portion of the longitudinally extended portion of the elastic member 234 can press the first end cap 250 when the brush holder 232 is moved upward.

As the at least portion of the elastic member 234 presses the inner circumferential surface of the body member 210 or the first end cap 250, it is possible to prevent the brush holder 232 from being extended by the centrifugal force and to provide an elastic force that brings the brush holder 232 in an extended state back to its original state.

Hereinafter, an agitator according to another implementation of the present disclosure will be described.

Figure 8:
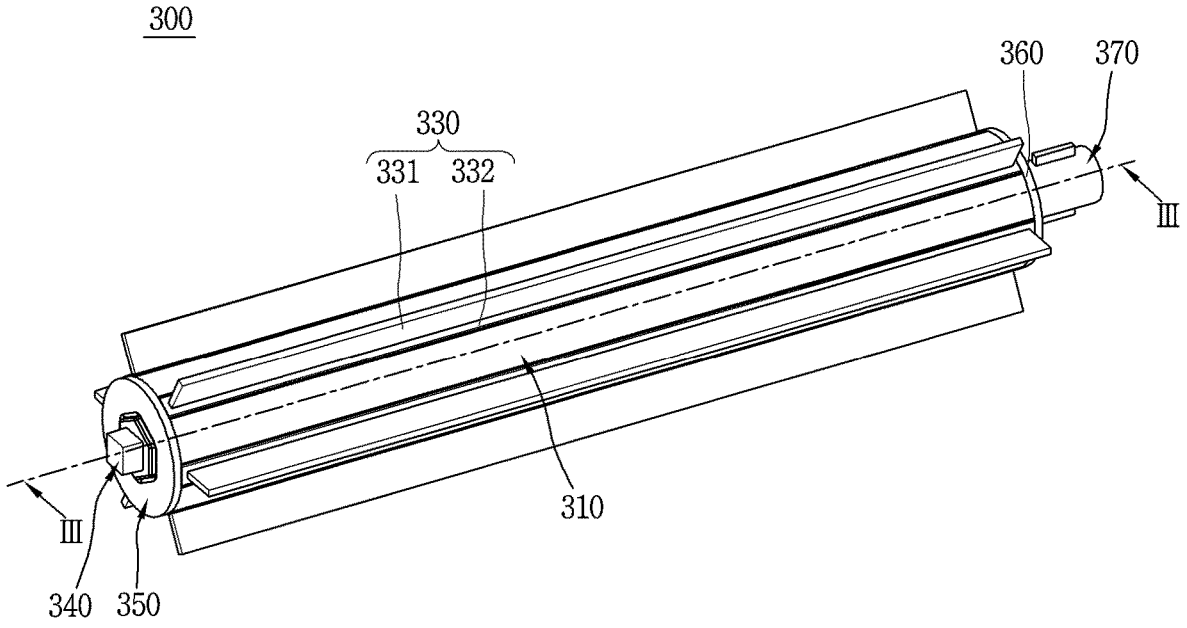
FIG. 8 is a perspective view of an agitator according to another implementation of the present disclosure.

FIG. 8 is a perspective view of an agitator according to another implementation of the present disclosure.

Referring to FIG. 8, an agitator 300 of the present disclosure includes a body member 310, a shaft 320 (see FIG. 9), a brush assembly 330, a power transmission unit 340, a first end cap 350, a second end cap 360, and a shaft accommodating part 370.

Before describing a configuration (constituting components) of the agitator 300 according to the present disclosure, directions used herein will be defined.

A "lengthwise or longitudinal direction" used hereinafter refers to an axial direction of the shaft 320 (see FIG. 9) to be described hereinafter. That is, the "lengthwise direction" is a direction from the first end cap 350 to the second end cap 360, and a direction from the second end cap 360 and to the first end cap 350.

A "radiation direction" used hereinafter refers to a direction of the shortest distance from one point of a central axis from which the shaft 320 (see FIG. 9) described hereinafter extends to another point of an outer circumferential surface of the body member 310 located on a plane perpendicular to the central axis.

A "circumferential direction" used hereinafter refers to a rotational direction when a virtual line perpendicular to a central axis of the shaft 320 (see FIG. 9) described hereinafter is rotated along the central axis.

In addition, a "front" used hereinafter refers to a side toward the first end cap 350, and a "rear" refers to a side toward the second end cap 360.

The body member 310 may have an inner circumferential surface and an outer circumferential surface and be configured as a hollow hole with both sides open. The shaft 320 (see FIG. 9) described hereinafter may be inserted into the hollow hole of the body member 310 in the lengthwise direction, and front and rear sides (or portions) of the shaft 320 may be accommodated in the first end cap 350 and the second end cap 360, respectively.

As the both sides of the shaft 320 (see FIG. 9) are respectively accommodated in the first end cap 350 and the second end cap 360, the shaft 320 may reciprocate in the lengthwise direction. This will be described in detail later.

The first end cap 350 accommodates the front side of the shaft 320 (see FIG. 9) while being fitted to one end of the body member 310, so as to cover the one end of the body member 310.

The second end cap 360 accommodates the rear side of the shaft 320 (see FIG. 9) while being fitted to another end of the body member 310, so as to cover the another end of the body member 310.

The rear side of the shaft 320 (see FIG. 9) penetrates through the second end cap 360 to be connected to the shaft accommodating part 370.

The body member 310 may be provided with an accommodation groove 311 (see FIG. 9) that is recessed radially inward of the outer circumferential surface thereof along the lengthwise direction by a predetermined length, so as to accommodate the brush assembly 330. The brush assembly 330 may be inserted radially inward of the accommodation groove 311 (see FIG. 9) along the lengthwise direction. The inserted brush assembly 330 may be extended by protruding in the radial direction. This will be described in detail later.

The brush assembly 330 may include a brush holder 332 inserted into the accommodation groove 311 (see FIG. 9) and a brush 331 coupled to the brush holder 332 along the lengthwise direction.

When the body member 310, the first end cap 350, and the second end cap 360 are defined as a body part, the shaft 320 (see FIG. 9) is accommodated in a hollow hole of the body part in the lengthwise direction, allowing the shaft 320 to perform a reciprocating motion in the body part in the lengthwise direction by a predetermined length or distance.

The brush assembly 330 may be in contact with an outer circumferential surface of the body part in the lengthwise direction so as to rotate together with the body part in the circumferential direction.

Figure 9:
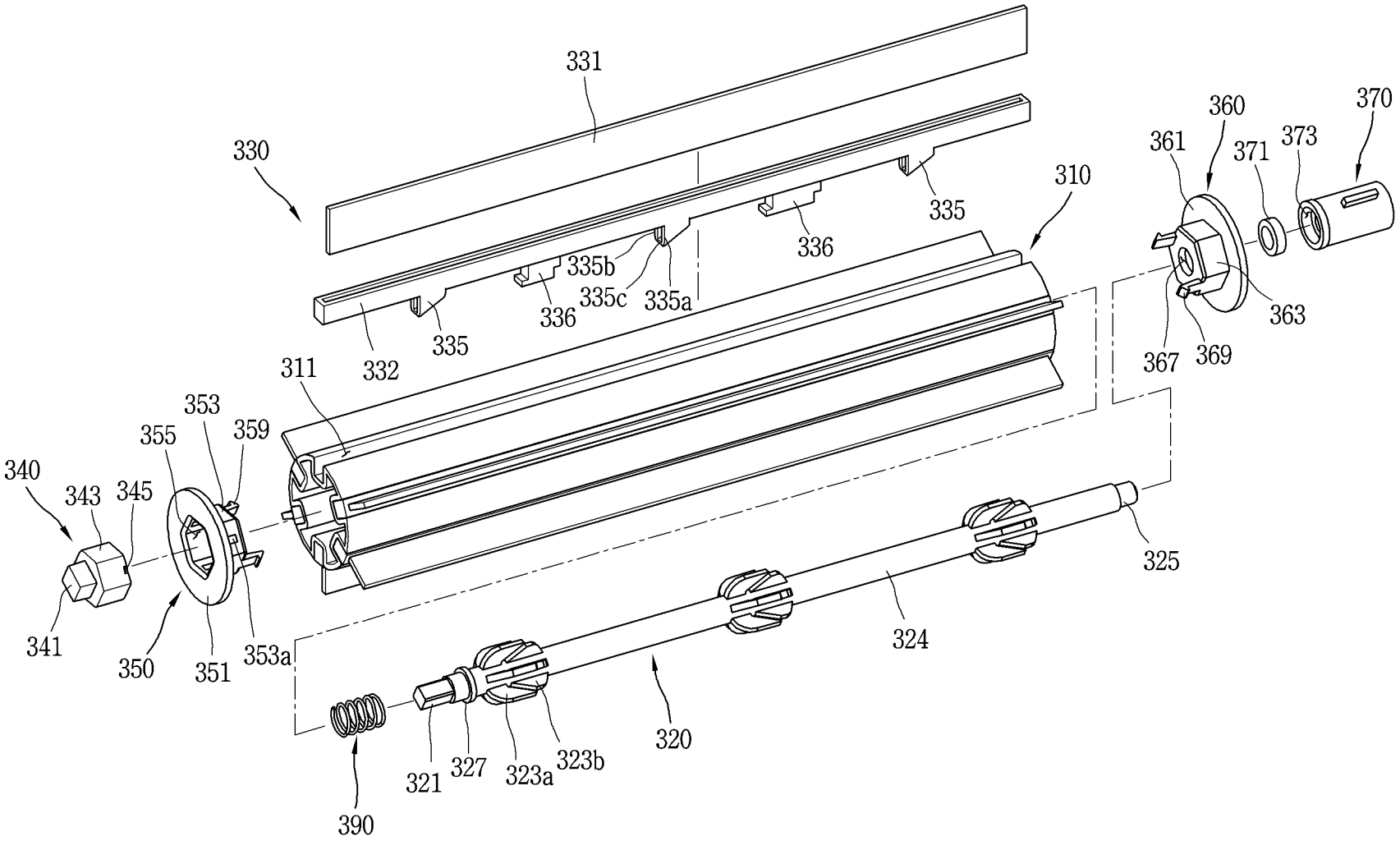
FIG. 9 is an exploded view of the agitator in FIG. 8.

FIG. 9 is an exploded perspective view of the agitator 300 in FIG. 8.

With reference to FIG. 9, the body member 310, the shaft 320, the brush assembly 330, the power transmission unit 340, the first end cap 350, the second end cap 360, and the shaft accommodating part 370 will be described in sequence.

The agitator 300 according to this implementation of the present disclosure performs the same functions as the agitator 200 of the previous implementation. The agitator 300, which is an improved form of the agitator 200, has a modified cam structure and a modified elastic member, so a description will be focused on the improvements.

First, the body member 310 according to another implementation of the present disclosure will be described.

The body member 310 may have the inner and outer circumferential surfaces, be configured as a hollow hole with both ends open, and be provided with the accommodation groove 311 recessed radially inward from the outer circumferential surface thereof along the lengthwise direction by a predetermined length.

The accommodation groove 311 may include two surfaces that are opposite to each other and in contact with the brush holder 332 so as to allow the brush holder 332 to be slidably inserted, and a bottom surface that supports a surface in an insertion direction of the brush holder 332. A plurality of through-holes 315 and 317 (see FIG. 9) may be defined in the bottom surface.

The shaft 320 may be accommodated in the hollow hole of the body member 310 in the lengthwise direction. The brush assembly 230 may be inserted radially inward of the accommodation groove 311 of the body member 310. The first end cap 350 and the second end cap 360 may be inserted into the both open ends of the body member 310, respectively.

Hereinafter, the shaft 320 according to another implementation of the present disclosure will be described.

A second cam 323 provided at the shaft 320 includes an insertion portion 323*a* and a pressing portion 323*b*, which is an improved form of the second cam 223 of the shaft 220 according to the previous implementation of the present disclosure. This will be discussed in detail hereinafter.

The shaft 320 may be accommodated in the hollow hole of the body member 310 in the lengthwise direction, and the both sides thereof may be accommodated in the first end cap 350 and the second end cap 360, respectively, so as to reciprocate in the lengthwise direction.

The shaft 320 has a front end portion 321, a rear end portion 325, and a connecting portion 324 that connects the front end portion 221 and the rear end portion 221. In addition, a second camp 323 may protrude radially outward from the outer circumferential surface of the connecting portion 324.

The second cam 323 may include the insertion portion 323*a* and the pressing portion 323*b*, which may extend radially outward from the connecting portion 324 of the shaft 320. An inclined guide groove may be provided between the insertion portion 323*a* and the pressing portion 323*b* in the lengthwise direction.

The insertion portion 323*a* and the pressing portion 323*b* may be located on the same line in the lengthwise direction. A rear side of the insertion portion 323*a* may be inclined at a first inclination along the lengthwise direction, and a front side of the pressing portion 323*b* may be inclined at a first inclination along the lengthwise direction. The pressing portion 323*b* may be spaced apart from the insertion portion 323*a* in a rearward direction of the shaft 320.

The second cam 323 may be provided in plurality to be disposed at the outer circumferential surface of the shaft 320 along the circumferential direction. As the second cams 323 protrude toward the brush assembly 330, the second cams 323 may be provided at the outer circumferential surface of the shaft 320 along the circumferential direction as many as the number of brush assemblies 330.

In addition, the second cam 323 may be provided in plurality along the lengthwise direction of the shaft 320. The second cam 323 provided at the outer circumferential surface of the shaft 320 may be in contact with a first cam 335 provided at the brush assembly 330.

The front end portion 321 of the shaft 320 may be accommodated in a rear side of the first end cap 350, and the rear end portion 325 of the shaft 320 may be accommodated in a front side of the second end cap 360.

Here, the front end portion 321 and the rear end portion 325 of the shaft 320, and the connecting portion 324 that connects the two end portions may have different shapes.

In some implementations, the front end portion 321 of the shaft 320 may be formed in a polygonal column shape. Accordingly, when the body member 310, the first end cap 350, and the second end cap 360 rotate, an outer circumferential surface of the front end portion 321 having the polygonal column shape may rotate together with the first end cap 350 in an engaged manner without being loose.

Here, the polygonal column shape may not necessarily include only straight lines, and include all different shapes with a combination of a straight line and a curved line, in addition to a cylindrical shape.

In addition, the front end portion 321 of the shaft 320 may be formed such that a length (insertion length) of the front end portion 321 of the shaft 320 that is inserted into the first end cap 350 is limited. In some implementations, at least a portion of the outer circumferential surface of the front end portion 321 of the shaft 320 may be radially stepped with respect to an outer circumferential surface of the connecting portion 324. That is, when the front end portion 321 of the shaft 320 is inserted and accommodated in the first end cap 350, the insertion length of the front end portion 321 may be limited by the step between the front end portion 321 and the connecting portion 324 of the shaft 320.

Unlike the shaft 220 according to the previous implementation, the shaft 320 according to this implementation may include a rim portion 327 that radially protrudes from an outer circumferential surface of the front side thereof along the circumferential direction by a predetermined distance. A front surface of the rim portion 327 may be coupled to a rear side of a spring 390 that surrounds the front end portion 321 of the shaft 320. This will be described in detail later.

The rear end portion 325 of the shaft 320 may be formed in a cylindrical shape. The rear end portion 325 of the shaft 320 having the cylindrical shape is accommodated in the shaft accommodating part 370 by penetrating through the second end cap 360. Accordingly, the shaft accommodating part 370 may remain in a non-rotational state when the body member 310, the first end cap 350, the second end cap 360, the shaft 320, and the brush assembly 330 rotate together.

To this end, a bearing 371 may be provided between an outer circumferential surface of the rear end portion 325 of the shaft 320 and the shaft accommodating part 370 in which the outer circumferential surface of the rear end portion 325 is accommodated.

In addition, the rear end portion 325 of the shaft 320 may be formed such that a length (insertion length) of the rear end portion 325 of the shaft 320 that is inserted into the shaft accommodating part 370 by penetrating through the second end cap 350 is limited. In some implementations, at least a portion of the outer circumferential surface of the rear end portion 325 of the shaft 320 may be radially stepped with respect to the outer circumferential surface of the connecting portion 324. That is, when the rear end portion 325 of the shaft 320 is inserted and accommodated in the second end cap 360, the insertion length of the rear end portion 325 may be limited by the step between the rear end portion 325 of the shaft 320 and the connecting portion 324. In other words, when the rear end portion 325 of the shaft 320 is inserted into the shaft accommodating part 370, a stepped surface between the rear end portion 325 of the shaft 320 and the connecting portion 324 presses a front surface of the bearing 371 to thereby limit the insertion length of the rear end portion 225.

The connecting portion 324 of the shaft 320 may be formed in a cylindrical shape or a polygonal column shape. In some implementations, the polygonal column shape may not necessarily include only straight lines and include all different shapes with a combination of a straight line and a curved line, in addition to a cylindrical shape. However, in order for the shaft 320 to be efficiently rotated, a central axis of rotation should coincide with the center of mass.

Hereinafter, the brush assembly 330 according to another implementation of the present disclosure will be described.

The brush assembly 330 is inserted into the accommodation groove 311 recessed radially inward from the outer circumferential surface of the body member 310 along the lengthwise direction by a predetermined length. As the shaft 320 reciprocates in the lengthwise direction, the brush assembly 330 may move upward and downward in the radial direction.

The brush assembly 330 may include the brush 331, the brush holder 332 that accommodates the brush 331 to be coupled to each other. In some implementations, the brush 331 and the brush holder 332 may have substantially the same length in the lengthwise direction. As the body member 310 rotates, and the brush holder 332 that is coupled to the body member 310 rotates, the brush 331 may also rotate together. The brush 331 may have a predetermined radial length, and a radial outer end portion of the brush 331 may lift or pick up dust or dirt from the floor.

The brush holder 332 may include a bottom surface that is in contact with the brush 331 and connects two walls opposite to each other and a radial inner end portion of the two walls. That is, the two walls of the brush holder 332 may be brought into contact with the two opposite walls of the accommodation groove 311 to be inserted, and the bottom surface of the brush holder 332 may be in contact with the bottom surface of the accommodation groove 311.

Unlike the brush holder 232 according to the previous implementation, the guide protrusion may not be formed on the brush holder 332 according to this implementation. This is because sufficient stability can be provided to upper and lower movement of the brush holder 332 through the improved cam structure described hereinafter. This will be described in detail later.

The bottom surface of the brush holder 332 may be in contact with the bottom surface of the accommodation groove 311, and the first camp 335 and a separation prevention portion 336 may be provided at the bottom surface of the brush holder 332 in positions corresponding to the plurality of through-holes 315 and 317.

Unlike the brush holder 232 according to the previous implementation, the brush holder 332 according to this implementation is not provided with the elastic member. This is because an improved cam structure, which will be described hereinafter, may prevent the brush assembly 330 from being projected by a centrifugal force. This will be described in detail later.

The first cam 335 and the separation prevention portion 336 may extend from the bottom surface of the brush holder 332 toward the outer circumferential surface of the shaft 320, respectively.

While the brush holder 332 is inserted into the accommodation groove 311, the first cam 335 may extend from the bottom surface of the brush holder 332 toward the outer circumferential surface of the shaft 320.

While the brush holder 332 is inserted into the accommodation groove 311, the first cam 335 may extend radially inward from the bottom surface of the brush holder 332 by a predetermined length through the first through-hole 315 (see FIG. 10A), so as to be in contact with the second cam 323 of the shaft 320. When the shaft 320 moves toward the first end cap 350 in the lengthwise direction, the first cam 335 may be pressed by the second cam 323 provided at the shaft 320 to be raised radially outward.

Unlike the first cam 235 according to the previous implementation, the first cam 335 according to this implementation may include a pair of wall portions 335*a* and 335*b* each having an end that is inclined along the lengthwise direction of the shaft 320, and an inclined portion 335*c* that connects the end portions of the pair of wall portions 335*a* and 335*b* to define an inner space.

The insertion portion 323*a* of the second cam 323 may be inserted into the inner space formed in the first cam 335 to be slidably inserted into the inner space along one surface of the inclined portion 335*c* that faces the inner space. Another surface of the inclined portion 333*b* may be supported by an inclined surface of the pressing portion 323*b*.

That is, the inclined portion 335*c* may be inserted into the inclined guide groove formed between the insertion portion 323*a* and the pressing portion 323*b* to be guided. This will be described in detail later.

As the second cam 323 of the shaft 320 is provided in plurality along the lengthwise direction, a plurality of the first cams 335 may be provided in positions corresponding to the second cams 323.

The separation prevention portion 336 may extend from the bottom surface of the brush holder 332 toward the outer circumferential surface of the shaft 320.

While the brush holder 332 is inserted into the accommodation groove 311, the separation prevention portion 336 may extend radially inward from the bottom surface of the brush holder 332 through the second through-hole 317 (see FIG. 10A) by a predetermined length. In a state that the brush holder 332 is inserted into the accommodation groove 311, at least a portion of the separation prevention portion 336 may overlap the body member 310 in the radial direction. When the brush holder 332 is raised radially outward as the shaft 320 moves toward the first end cap 350 in the lengthwise direction, the portion of the separation prevention portion 336 that radially overlaps the body member 310 presses an inner surface of the body member 310, thereby preventing the brush holder 332 from moving radially outward from the accommodation groove 311. This will be described in detail later.

Hereinafter, the power transmission unit 340 according to another implementation of the present disclosure will be described.

The power transmission unit 340 may include a motor connecting (or connection) portion 341 having a front side thereof connected to a first power module 13*a* (see FIG. 14), and an agitator connecting portion 343. The motor connecting portion 341 may be connected to the first power module 13*a* (see FIG. 14) to be rotated by the first power module 13*a* (see FIG. 14). As the motor connecting portion 341 rotates, the agitator connecting portion 343 that is joined to a rear side of the motor connecting portion 341 may be rotated. The agitator connecting portion 343 may be inserted by being engaged with an inner circumferential surface of a first cavity 355 formed on a front side of the first end cap 350 to cause the first end cap 350 to rotate, allowing the agitator 300 to be rotated.

The motor connecting portion 341 of the power transmission unit 340 may have a polygonal column shape so as to be engaged with the first power module 13*a* (see FIG. 14) and rotate without idling. The agitator connecting portion 343 provided at the rear side of the motor connecting portion 341 may have a polygonal column shape. An outer circumferential surface of the agitator connecting portion 343 may be inserted into the first cavity 355 that is recessed from the front side to the rear side of the first end cap 350. The outer circumferential surface of the agitator connecting portion 343 may be inserted by being at least partially engaged with an inner circumferential surface of the first cavity 355. This may allow a rotational force of the first power module 13*a* (see FIG. 14) to be transmitted to the first end cap 350. That is, the agitator connecting portion 343 may have the polygonal column shape that is engaged with at least a portion of the inner circumferential surface of the first cavity 355.

A coupling protrusion 345 may be formed on the outer circumferential surface of the agitator connecting portion 343. When the agitator connecting portion 343 is inserted into the first cavity 355, the coupling protrusion 345 may be inserted into a first coupling groove 353*a* formed in a first fitting portion 353 defining the first cavity 355. Accordingly, the agitator connecting portion 343 can be securely coupled to the first cavity 355 without being separated therefrom, allowing the power transmission unit 340 and the first end cap 350 to be coupled to each other.

Hereinafter, the first end cap 350 according to another implementation of the present disclosure will be described.

The first end cap 350 may accommodate the front end portion 321 of the shaft 320 so as to guide the shaft 320 to reciprocate in the lengthwise direction by a predetermined distance (or length). The first end cap 250 may cover one end of the body member 310 and one end of the accommodation groove 311.

The first end cap 350 may include the first fitting portion 353 that is engagingly fitted into the inner circumferential surface of the body member 310 so as to cover the one end of the body member 310, and the first end plate 351 that extends radially outward from a front side of the first fitting portion 353 so as to cover the one end of the accommodation groove 311.

The first fitting portion 353 may be configured as an outer wall that is engagingly fitted into the inner circumferential surface of the body member 310 along the circumferential direction and a bottom surface formed along the outer wall to cover the one end of the body member 310. The first cavity 355 is defined by the outer wall and the bottom surface.

Figure 10A:
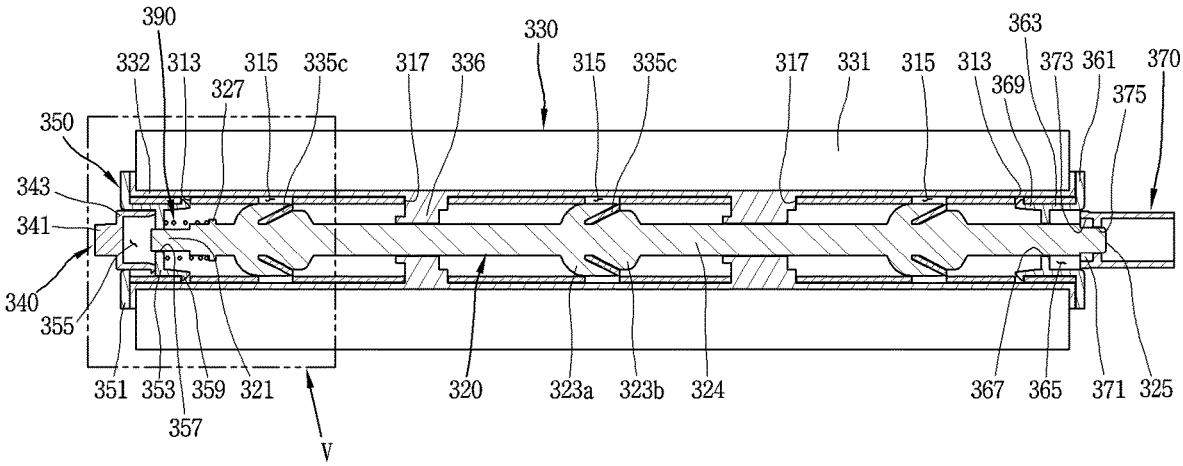
FIG. 10A is a cross-sectional perspective view taken along line "III-III" of the agitator in FIG. 8.

A first guide hole 357 (see FIG. 10A) that accommodated the front end portion 321 to guide it to the first cavity 355 of the first end cap 350 may be defined in the bottom surface of the first fitting portion 353, and a reciprocating motion of the shaft 320 in the lengthwise direction is guided through the first guide hole 357 (see FIG. 10A).

The first guide hole 357 (see FIG. 10A) may be engaged with the outer circumferential surface of the front end portion 321 of the shaft 320, so as to transmit a rotational force of the first end cap 350 to the front end portion 321 of the shaft 320. This will be described in detail later.

The inner circumferential surface of the first cavity 355 may be engaged with at least a portion of the outer circumferential surface of the agitator connecting portion 343 of the power transmission unit 340.

However, a longitudinal length of the first fitting portion 353 according to this implementation may be less than a longitudinal length of the first fitting portion 253 according to the previous implementation.

In the case of the first fitting portion 253 according to the previous implementation, since a space in which the front end portion 221 of the shaft 220 is inserted and a portion with which an end portion of the longitudinally extended portion of the elastic member 234 is in contact are required, a longitudinal length of the first cavity 255 should be secured, and the first fitting portion 252 should protrude in the rearward direction of the shaft 220 by a predetermined length so as to be in contact with the end portion of the longitudinally extended portion of the elastic member 234.

On the other hand, the agitator 300 according to this implementation requires no elastic member, the length of the first fitting portion 353 can be relatively short. As the length that is inserted into the body member 310 is reduced, a coupling force between the first end cap 350 and one end of the body member 310 may be reduced.

In order to compensate or prevent this, the first fitting portion 353 may include a first end cap coupling portion 359 extending from a rear side of the first fitting portion 353 to the rear side of the shaft 320. An end portion of the first end cap coupling portion 359 may be detachably coupled to an end cap coupling hole 313 defined in the bottom surface of the accommodation groove 311, thereby preventing separation of the first end cap 350 from the one end of the body member 310.

Hereinafter, the second end cap 360 according to another implementation of the present disclosure will be described.

The second end cap 360 may accommodate the rear side of the shaft 320 to allow the shaft 320 to reciprocate in the lengthwise direction by a predetermined distance (or length), cover another end of the body member 310 and another end of the accommodation groove 311.

The second end cap 360 may include a second fitting portion 363 that is engagingly fitted into the inner circumferential surface of the body member 310 so as to cover the another end of the body member 310, and the second end plate 361 that extends radially outward from a rear side of the second fitting portion 363 to cover the another end of the accommodation groove 311.

The second fitting portion 363 may be configured as an outer wall that is engagingly fitted into the inner circumferential surface of the body member 310 along the circumferential direction and a bottom surface that covers the another end of the body member 310. A second cavity 365 is defined by the outer wall and the bottom surface.

A second guide hole 367 (see FIG. 10A) that accommodates a rear side of the connecting portion 324 of the shaft 320 and guides the shaft 320 to the second cavity 365 of the second end cap 360 is defined in the bottom surface of the second fitting portion 363. A reciprocating motion of the second guide hole 367 (see FIG. 10A) allows the shaft 320 to perform a reciprocating motion in the lengthwise direction.

The second guide hole 367 (see FIG. 10A) may be engaged with an outer circumferential surface of the rear side of the connecting portion 324 of the shaft 320, so as to transmit a rotational force of the second end cap 350 to the rear side of the connecting portion 324 of the shaft 329.

When the shaft 320 moves in a direction toward the first end cap 350, the second cavity 365 accommodates the shaft accommodating part 370 in which the rear end portion 325 of the shaft 320 is accommodated.

When the second end cap 360 rotates, an inner circumferential surface of the second cavity 365 may not be brought into contact with the shaft accommodating part 370 that is accommodated in the second cavity 365.

Hereinafter, the shaft accommodating part 370 according to another implementation of the present disclosure will be described.

The shaft accommodating part 370 accommodates the rear end portion 325 of the shaft 320 and press the rear end portion 325 of the shaft 320 in its forward direction to move the shaft 320 in the lengthwise direction.

An accommodation space 373 in which the rear end portion 325 of the shaft 320 is accommodated may be formed in a front side of the shaft accommodating part 370. The accommodation space 373 may have a cylindrical shape to accommodate the rear end portion 325 of the shaft 320 with a cylindrical shape. The bearing 371 is inserted between an inner circumferential surface of the accommodation space 373 and the outer circumferential surface of the rear end portion 325 of the shaft 320 to radially support the rear end portion 325 of the shaft 320 while rotating. Accordingly, the shaft accommodating part 370 may be fixed without being rotated together with the shaft 320.

A protruding portion protrudes radially inward from an inner circumferential surface of the shaft accommodating part 370 along the circumferential direction. The protruding portion may support the bearing 371 or the rear end portion 325 of the shaft 320 in the lengthwise direction.

Hereinafter, a process of extending a length of the brush assembly 330 of the agitator 300 according to another embodiment of the present disclosure will be described with reference to FIGS. 10A and 10B.

Figure 10B:
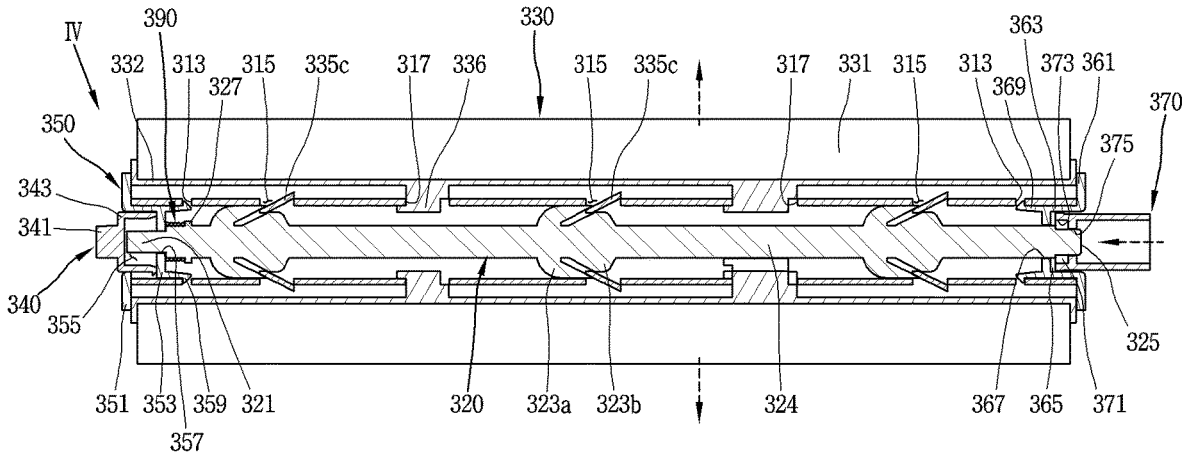
FIG. 10B is a cross-sectional view illustrating an extended state of a brush assembly of the agitator in FIG. 10A.

FIG. 10A illustrates a state before the brush assembly 330 of the agitator 300 is extended, and FIG. 10B illustrates a state in which the brush assembly 330 of the agitator 300 is extended.

FIG. 10A is a cross-sectional perspective view taken along line "III-III" of the agitator 300 in FIG. 8.

Referring to FIG. 10A, a state before the shaft 320 moves in a direction toward the first end cap 350 along the lengthwise direction is illustrated.

The shaft 320 is accommodated in the hollow hole of the body member 310 along the lengthwise direction. The first end cap 350 may accommodate the front end portion 321 of the shaft 320 and cover one end of the body member 310, and the second end cap 360 may accommodate the rear end portion 325 of the shaft 320 and cover another end of the body member 310.

At least a portion of the outer circumferential surface of the front end portion 321 of the shaft 320 may be engaged with an inner circumferential surface of the guide hole 357 defined in the first fitting portion 353 of the first end cap 350 to be accommodated in the first guide hole 357. The front end portion 321 of the shaft 320 is exposed to the first cavity 355 of the first end cap 350 by penetrating through the first guide hole 357.

At least a portion of the outer circumferential surface of the connecting portion 324 may be accommodated in the second guide hole 367 defined in the second fitting portion 363. The rear side of the connecting portion 324 penetrates through the second guide hole 367 to be exposed to the second cavity 365 of the second end cap 360.

The rear end portion 325 of the shaft 320 is accommodated in the accommodation space 373 of the shaft accommodating part 370. When the brush assembly 330 is extended, the shaft accommodating part 370 presses the rear end portion 325 of the shaft 320 to be accommodated in the second cavity 365 of the second end cap 360 together with the rear end portion 325 of the shaft 320.

That is, in order to extend the length of the brush assembly 330, a pressing module that is connected to the shaft accommodating part 370 presses the shaft accommodating part 370, and the shaft accommodating part 370 presses the rear end portion 325 of the shaft 320. Then, the shaft 320 is guided by the first guide hole 357 and the second guide hole 267 to thereby move in a forward direction of the body member 310 along the lengthwise direction. As the front end portion 321 of the shaft 320 protrudes in the forward direction of the body member 310 in the first cavity 355, and a radial stepped surface that connects the connecting portion 324 and the front end portion 321 of the shaft 320 presses the first end cap 350, movement of the shaft 320 may be stopped.

In some implementations, movement of the shaft 320 may be stopped as the moved front end portion 321 of the shaft 320 is pressed by being brought into contact with an inner surface of the agitator connecting portion 343 of the power transmission unit 340 that is inserted into the first cavity 355.

In some implementations, movement of the shaft 320 may be stopped by setting a length by which the shaft accommodating part 370 presses the shaft 320 to move.

The accommodation groove 311 formed along the lengthwise direction may be provided in plurality on the outer circumferential surface of the body member 310 along the circumferential direction. The first and second through-holes 315 and 317 may be defined in the bottom surface of the accommodation groove 311 by penetrating from the outer circumferential surface of the body member 310 to the outer circumferential surface of the shaft 320.

The brush holder 332 of the brush assembly 330 may be inserted into the accommodation groove 311. The first cam 235 and the separation prevention portion 336 may extend from the bottom surface of the brush holder 332 corresponding to positions of the first and second through-holes 315 and 317.

The first cam 335 may extend toward the outer circumferential surface of the shaft 320 through the first through-hole 315, so as to be in contact with the second cam 323 extending from the outer circumferential surface of the shaft 320 toward the first cam 335.

The first cam 335 may include the pair of wall portions 335*a* and 335*b* each having an end that is inclined along the lengthwise direction of the shaft 320, and the inclined portion 335*c* that connects the ends of the pair of wall portions 335*a* and 335*b* to form an inner space.

In addition, the second cam 323 may include the insertion portion 323*a* and the pressing portion 323*b* located on the same line in the lengthwise direction. The rear side of the insertion portion 323*a* may be inclined at a predetermined inclination along the lengthwise direction. The front side of the pressing portion 323*b* may be inclined at a predetermined inclination along the lengthwise direction, and the pressing portion 323*b* may be spaced apart from the insertion portion 323*a* in the rearward direction of the shaft 320. That is, an inclined guide groove inclined at a predetermined inclination may be formed between the insertion portion 323*a* and the pressing portion 323*b*.

The inclined portion 335*c* of the first cam 335 may be inclined substantially the same as the inclined guide groove and be inserted into the inclined guide groove between the inclined rear side of the insertion portion 323*a* and the inclined front side of the pressing portion 323*b* to be guided.

Accordingly, when the second cam 323 moves in the forward direction of the body member 310 along the lengthwise direction, the pressing portion 323*b* of the second cam 323 may press the first cam 335 through a contact surface with the inclined portion 335*c*. The first cam 335 may be raised in the radial direction by using a force that the pressing portion 323*b* of the second cam 323 presses the inclined portion 335*c* of the first cam 335 in the lengthwise direction.

Dynamics between the inclined front side of the pressing portion 323*b* and the inclined portion 335*c* when engaged with each other are the same as the previous implementation, so a description thereof will be omitted.

When the inclined portion 335*c* is inserted into the inclined guide groove of the second cam 323, the insertion portion 323*a* of the second cam 323 may be fitted into the inner space formed by the wall portions 335*a* and 335*b*, and the inclined portion 335*c* of the first cam 335.

Accordingly, when a centrifugal force is generated in the brush assembly 330 by rotation of the agitator 300, the inclined rear side of the insertion portion 323*a* presses the inclined portion 335*c* radially inward from the inner space of the first cam 335 to thereby prevent the brush assembly 330 from being extended by rotation.

Thus, the brush assembly 330 can be prevented from being extended by the centrifugal force without the elastic member.

However, in the previous implementation, the elastic member 234 serves to allow pressed and extended brush assembly 230 to be returned to its original length or position, as well as to prevent the brush assembly 230 from being extended by the centrifugal force.

When the elastic member is not provided at the brush assembly 330 as in this implementation, a separate or additional component is required to bring the extended brush assembly 330 back to its original position.

Therefore, a spring 390 may be provided at a front side of the shaft 320.

The rim portion 327 may radially protrude from an outer circumferential surface of the front side of the shaft 320 along the circumferential direction. The spring 390 surrounding the front end portion 321 of the shaft 320 may have a front side coupled to the first end cap 350 and a rear side coupled to the front surface of the rim portion 327.

When the rear side of the shaft 320 is pressed by the shaft accommodating part 370, the shaft 320 may move in its forward direction along the lengthwise direction, and as the pressing portion 323*b* of the second cam 323 of the shaft 320 presses the inclined portion 335*c* of the first cam 335 of the brush assembly 330, the brush assembly 330 may be raised in the radial direction to be extended.

As the shaft 320 moves forward along the lengthwise direction, the spring 390 is pressed by the front surface of the rim portion 327, such that a length of the spring 390 is reduced. An elastic force of the spring 390 is applied to the front surface of the rim 327 in the rearward direction of the shaft 320.

When a floor surface to be cleaned is changed from a carpet to a hard surface floor, and the force applied to the shaft 320 by the shaft accommodating part 370 is released, the shaft 320 may be moved in its rearward direction by the elastic force applied to the front surface of the rim portion 327.

When the shaft 320 is moved in its rearward direction, the inclined rear side of the insertion portion 323*a* of the second cam 323 that is inserted into the inner space of the first cam 335 presses the inclined portion 323*c* of the first cam 335. Accordingly, the inclined portion 323*c* can be guided radially inward along the inclined guide groove of the second cam 323.

That is, when the floor surface to be cleaned is changed from the carpet to the hard surface floor, and the force applied by the shaft accommodating part 370 disappears, the brush assembly 330 extended by the elastic force of the spring 390 may be returned to be radially inward.

Advantages of the spring 390 over the elastic member 234 are as follows.

When a correlation between an elastic force applied to the body member 210 or the first end cap 250 by the elastic member 234 and a separation distance that the elastic member 234 is spaced apart from the bottom surface of the brush holder 232 defines as a function, the elastic force and the separation distance may be represented by the geometric nonlinear function.

As for the elastic member 234, not only the longitudinally extended portion is bent, but also the radially extended portion connected to the longitudinally extended portion is bent. A position that presses the body member 210 or the first end cap 250 may also vary. Therefore, there are many variables to consider.

That is, it may be difficult to accurately calculate an elastic force applied to the body member 210 or the first end cap 250 according to the separation distance between the elastic member 234 and the bottom surface of the brush holder 232.

When the elastic member 234 is made of a material having high elasticity to prevent the brush assembly 230 from being extended by the centrifugal force of the agitator 200, a force applied to the shaft 220 by the shaft accommodating part 270 to extend the length of the brush assembly 230 may be unnecessarily increased, or plastic deformation of the elastic member 234 may occur.

On the other hand, when the elastic member 234 is made of a material having low elasticity, the brush assembly 230 may not be returned to its original position and remained in the extended state after being extended as the agitator 200 rotates or after the force applied to the shaft 220 by the shaft accommodating part 270 is released.

As for the spring 390, a length compressed in a lengthwise direction of the spring 390 and an elastic force generated accordingly may be represented by a linear function. If an elasticity coefficient of the spring 390 is 'k', a length compressed in the lengthwise direction of the spring 390 is 'x', and an elastic force generated by the spring 390 is 'f', then the correlation between the elastic force and the compressed length may be defined by $f=-k*x$.

That is, the spring 390 may provide an elastic force proportional to the length compressed in a direction opposite to the compressed direction.

Using this linearity, tension between the centrifugal force and the elastic force acted on the brush holder 332 may be adjusted, allowing a force that the shaft accommodating part 370 presses the shaft 320 to be set effectively. In this implementation, when the agitator 300 sets such that the brush assembly 330 is extended at a predetermined rotational speed, the sum of centrifugal forces generated in the brush assembly 330 of the agitator 300 at the predetermined rotational speed may be specified.

The sum of the specified centrifugal forces is applied to the inclined rear side of the insertion portion 323*a* of the shaft 320 through the inclined portion 335*c* of the brush assembly 330, and the centrifugal force applied to the outside in the radial direction from the inclined rear side is converted to a longitudinal force that presses the shaft 320 in its forward direction.

If the longitudinal force of pressing the shaft 320 in its forward direction by the centrifugal force at the predetermined rotational speed is 'F1', then the two forces are offset when the sum of F1 and the elastic force f becomes 0, and the brush assembly 330 may set not to protrude radially outward until the predetermined rotational speed reaches.

$$F1+f=0 \quad (1)$$

$$F1-k*x=0. \quad (2)$$

$$F1=k*x. \quad (3)$$

$$x=F1/k \quad (4)$$

That is, the spring 390 may be compressed by the length "x" calculated by using the longitudinal force F1 that presses the shaft 320 in its forward direction by the centrifugal force generated at the predetermined rotational speed and the elasticity coefficient k of the spring 390, so as to be located between the first end cap 350 and the rim portion 327.

Accordingly, before reaching the predetermined rotational speed at which the brush assembly 330 is extended, a force that presses the shaft 320 rearward by the spring 390 is greater than a force that presses the shaft 320 forward by the centrifugal force generated in the brush assembly 330, thereby preventing the brush assembly 330 from being extended.

In addition, at the predetermined rotational speed at which the brush assembly 330 is extended, the sum of forces of pressing the shaft 320 in its forward direction by the centrifugal force generated in the brush assembly 330 and pressing the shaft 320 in its rearward direction by the spring 390 becomes 0 (zero). Thus, when the shaft accommodating part 370 presses the rear end portion 325 of the shaft 320, the brush assembly 330 can be easily extended without resistance by the spring 390.

Further, in this implementation, the bottom surface of the brush holder 332 can be used more efficiently by employing the spring 390 that surrounds the shaft 320, instead of the elastic member. That is, more first cams 335 are provided to allow a force to be distributed, thereby reducing load applied between each of the first cams 335 and the second cams 323. As a result, durability may be improved. By providing more first cams 335 and separation prevention parts 336, length extension of the brush assembly 330 can be performed in a more stable manner.

The separation prevention portion 336 may extend radially inward toward the outer circumferential surface of the shaft 320 through the second through-hole 317.

The operating principle of the separation prevention portion 336 according to this implementation is the same as the separation prevention portion 236 of the previous implementation, so a detailed description thereof will be omitted.

Hereinafter, a state in which the brush assembly 330 of the agitator 300 is extended will be described.

FIG. 10B is a cross-sectional view illustrating an extended state of the brush assembly 330 of the agitator 300.

Referring to FIG. 10B, a state in which the brush assembly 330 is extended state as the shaft accommodating part 370 presses the rear end portion 325 of the shaft 320 to move the shaft 320 in its forward direction (or forward) along the lengthwise direction is illustrated.

As the brush assembly 330 is extended, the brush 331 may reach the surface of a carpet. Dust or dirt accumulated on the surface of the carpet may be lifted or picked up so as to be sucked into the suction nozzle.

As the shaft 320 is moved forward along the lengthwise direction, the second cam 323 extending from the outer circumferential surface of the connecting portion 324 of the shaft 320 presses the first cam 335, allowing the brush assembly 330 to be raised radially outward.

The front end portion 321 of the shaft 320 is moved forward along the lengthwise direction until it is brought into contact with the agitator connecting portion 343 that is inserted into the first cavity 355.

Or, the front end portion 321 of the shaft 320 may have a short longitudinal length and be moved until the stepped surface that connects the outer circumferential surface of the connecting portion 324 and the outer circumferential surface of the front end portion 321 of the shaft 320 presses the rear side of the first end cap 350.

As the shaft 320 moves, the brush assembly 330 is raised in the radial direction. Then, the first cam 335 and the separation prevention portion 336 of the brush holder 332 are raised in the radial direction.

The separation prevention portion 336 of the brush holder 332 is guided radially outward to move upward along the second through-hole 317, and a portion of the separation prevention portion 336 that radially overlaps the body member 310 presses the inner surface of the body member 310, thereby preventing the brush assembly 330 from being separated from the accommodation groove 311.

In addition, when a contact area between the brush holder 332 and the accommodation groove 311 is reduced as the brush assembly 330 is extended, the pair of wall portions 335*a* and 335*b* of the first cam 335 are brought into contact with the insertion portion 323*a* of the shaft 320 to be fixed without being shaken in the circumferential direction, thereby preventing the brush holder 332 from being shaken in the circumferential direction.

As described above, when the shaft 320 is moved its forward direction and the brush assembly 330 is extended, the spring 390 may be compressed. Then, the compressed spring 390 may press the front surface of the rim portion 327 in the rearward direction of the shaft 320.

As a floor surface to be cleaned is changed from a carpet to a hard flat surface, a force applied to the rear end portion 325 of the shaft 320 is released. Then, the extended brush assembly 330 may be returned to a prior state (or its original position) by the force that presses the front side surface of the rim portion 327.

Figure 11A:
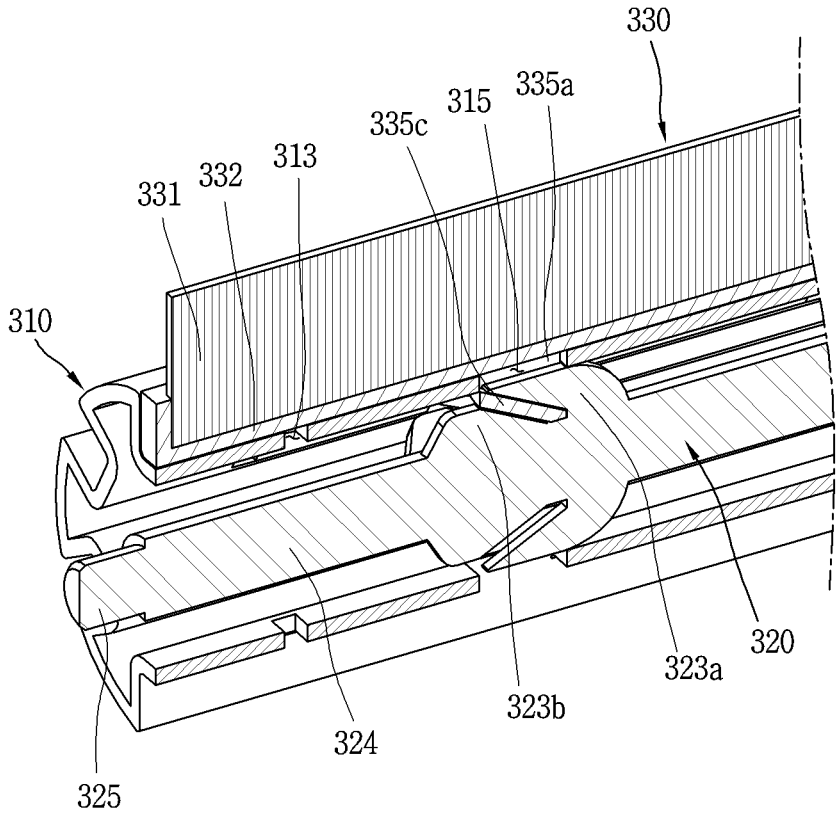
FIG. 11A is a cross-sectional perspective view illustrating a portion "IV" of the agitator in FIG. 10A.
Figure 11B:
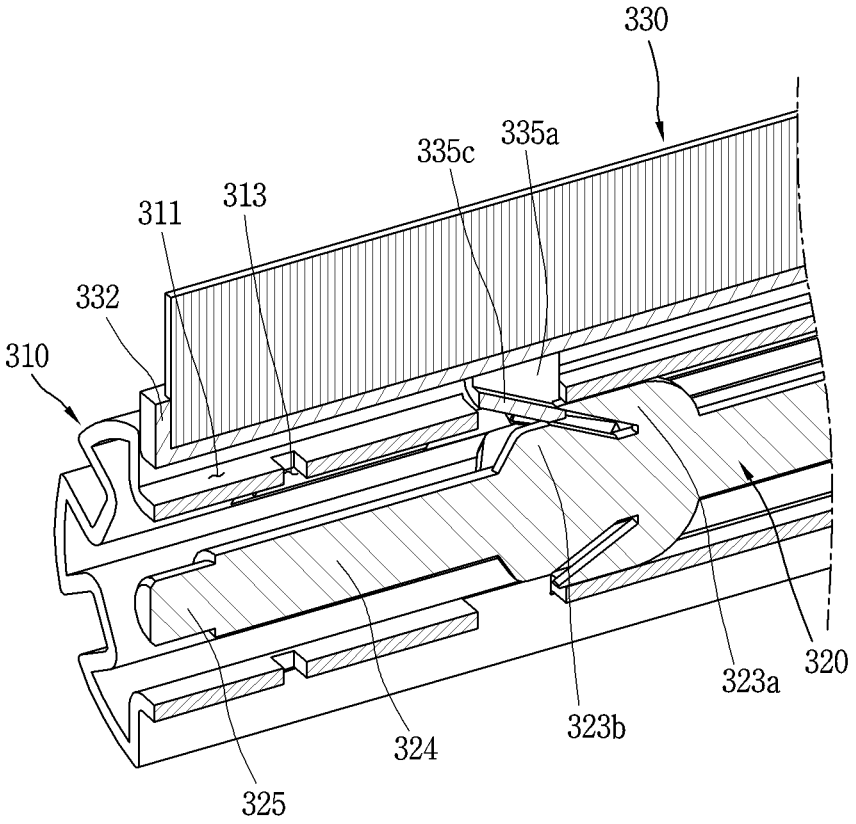
FIG. 11B is a cross-sectional perspective view illustrating an extended state of the brush assembly in the agitator of FIG. 11A.

FIG. 11A is a cross-sectional perspective view illustrating a portion "IV" of the agitator 300 in FIG. 10A, and FIG. 11B is a cross-sectional perspective view illustrating an extended state of the brush assembly 330 of the agitator 300 in FIG. 11A.

In FIGS. 11A and 11B, a mechanism in which the brush assembly 330 is extended as the shaft 320 is pressed from its rearward direction is illustrated. For the sake of convenience, some components are omitted.

The first cam 335 may be provided with the pair of wall portions 335*a* and 335*b* each having an end that is inclined along the lengthwise direction of the shaft 320, and the inclined portion 335*c* connecting the ends of the pair of wall portions 335*a* and 335*b* so as to form an inner space.

That is, the inner space of the first cam 335 is formed in a columnar shape having a trapezoidal cross-section in which one of the four sides is inclined.

The inner space of the first cam 335 may accommodate the insertion portion 323*a* of the second cam 335. An inclined portion of the insertion portion 323*a* is in a sliding contact along a surface of the inclined portion 335*c* that faces the inner space of the inclined portion 335*c*, and the insertion portion 323*a* is fixedly inserted into the inner space of the first cam 335 in the circumferential direction.

When a gap (or distance) between the pair of wall portions 335*a* and 335*b* of the first cam 335 and the insertion portion 323*a* is too large, the insertion portion 323*a* that is inserted into the inner space of the first cam 335 may be shaken in the circumferential direction. As a result, a frictional force may be increased while the brush assembly 330 is being extended.

An opposite surface of the surface facing the inner space of the inclined portion 335*c* may be in a sliding contact with an inclined portion of the pressing portion 323*b*. This may allow the inclined portion 335*c* of the first cam 335 to be slidably moved between the insertion portion 323*a* and the inclined portion of the pressing portion 323*b*.

Since the first cam 335 is fixed in the lengthwise direction and the circumferential direction by the first through-hole 315, the first cam 335 may be moved upward and downward only in the radial direction.

As the inclined portion of the pressing portion 323*b* presses the inclined portion 335*c*, the inclined portion 335*c* may be raised radially outward between the insertion portion 323*a* and the inclined portion of the pressing portion 323*b* along the inclined portion of the pressing portion 323*b*.

In addition, the inclined portions of the insertion portion 323*a* and the pressing portion 323*b* are inclined at substantially the same inclination. The inclined guide groove formed between the inclined portions of the insertion portion 323*a* and the pressing portion 323*b* may be formed such that the inclined portion 335*c* of the first cam 335 is fixed in the radial direction. That is, the gap between the inclined portion 335*c* and the insertion portion 323*a*, and the gap between the inclined portion 335*c* and the pressing portion 323*b* may be formed such that the inclined portion 335*c* is fixed in the radial direction.

When the agitator 300 rotates, a centrifugal force is applied radially outward to the inclined portion 335*c* of the first cam 335, and thus, the inclined portion 335*c* may be brought into contact with the inclined portion of the insertion portion 323*a* accommodated in the inner space. Here, if the gap between the inclined portions of the inclined portion 335*c* and the pressing portion 323*b* is large, the inclined portion of the pressing portion 323*b* may strike or hit the inclined portion 335*c* when the shaft 320 is pressed.

This may unnecessarily increase friction between the inclined portion 335*c*, the insertion portion 323*a*, and the pressing portion 323*b*. Thus, the gap between the inclined portion 335*c* and the insertion portion 323*a*, and the gap between the inclined portion 335*c* and the pressing portion 323*b* should be minimized.

Figure 12A:
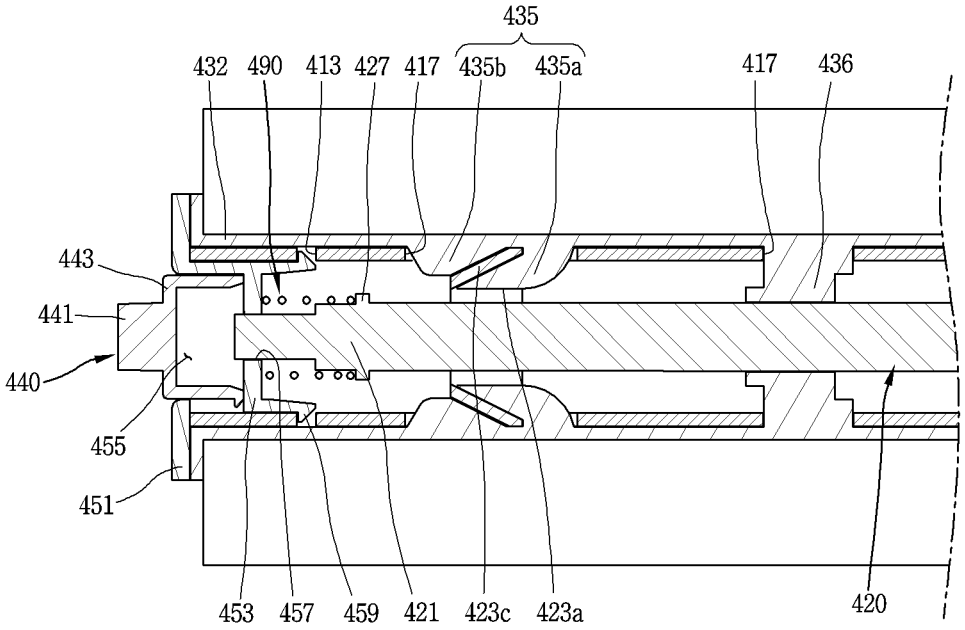
FIG. 12A is a cross-sectional perspective view illustrating a modified example of the agitator in FIG. 10A.
Figure 12B:
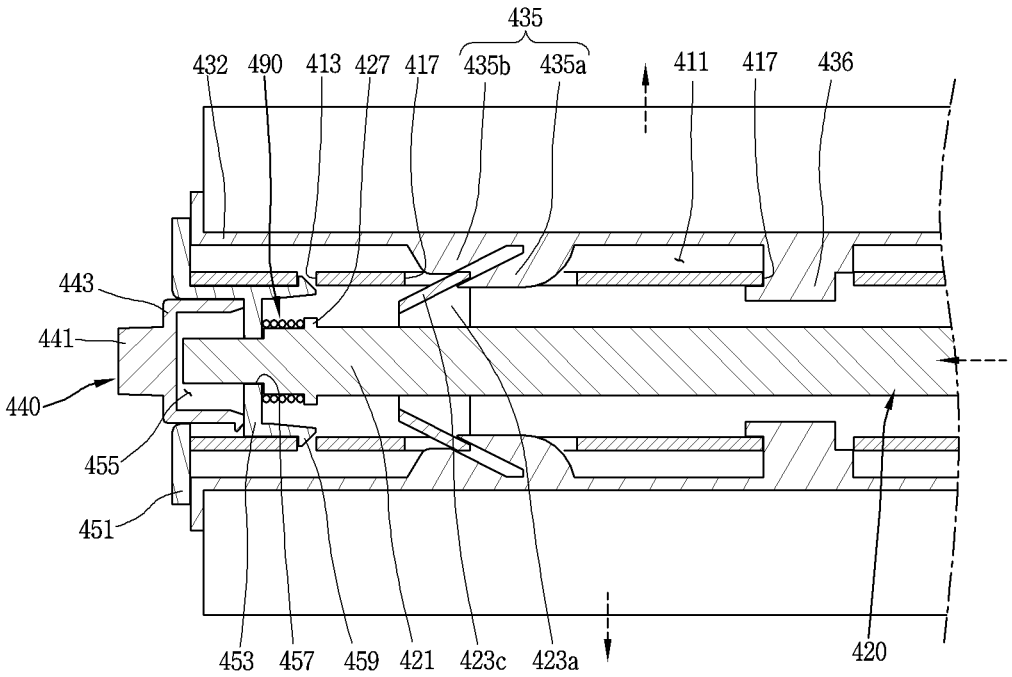
FIG. 12B is a cross-sectional perspective view illustrating an extended state of a brush assembly of the agitator in FIG. 12A.

FIGS. 12A and 12B are cross-sectional views illustrating a modified example of a cam structure of the agitator 300 in FIGS. 10A and 10B.

The modified example of FIGS. 12A and 12B has a structure in which the first cam and the second cam are reversed from the agitator 300 illustrated in FIGS. 10A and 10B, and the rest of the configuration is the same except the first cam 353 and the second cam 323.

Reference numerals of the components except the first cam 335 and the second cam 323 are different by 100. For example, a body member 410 illustrated in FIGS. 12A and 12B may function equally as the body member 310 illustrated in FIGS. 10A and 10B.

Hereinafter, a modified cam structure will be described.

In the modified example illustrated in FIGS. 12A and 12B, a shaft 420 may be provided with a second cam 423 extending from an outer circumferential surface thereof toward a brush assembly 430.

The second cam 423 may be provided with a pair of wall portions 423*a* and 423*b* each having an end inclined along a lengthwise direction of the shaft 420, and an inclined portion 423*c* connecting the ends of the pair of wall portions 423*a* and 423*b* to form an inner space.

That is, the inner space of the second cam 423 is formed in a columnar shape with a trapezoidal cross-section in which one of the four sides is inclined.

A brush holder 432 of the brush assembly 430 may be provided with a first cam 435 extending from the brush holder 432 toward the second cam 423.

The first cam 435 may include an insertion portion 435*a* and a pressing portion 435*b*. The insertion portion 435*a* and the pressing portion 435*b* may extend radially outward from a connecting portion 424 of the shaft 420, and an inclined guide groove may be formed between the insertion portion 435*a* and the pressing portion 435*b* in the lengthwise direction.

The insertion portion 435*a* and the pressing portion 435*b* may be located on the same line in the lengthwise direction. A front side of the insertion portion 435*a* may be inclined along the lengthwise direction, and a rear side of the pressing portion 435*b* may be inclined along the lengthwise direction. The insertion portion 435*a* may be spaced apart from the pressing portion 435*b* in a forward direction of the shaft 420 by a predetermined distance.

The inner space of the second cam 423 may accommodate the insertion portion 435*a* of the first cam 435. An inclined portion of the insertion portion 435*a* may be in a sliding contact along a surface facing an inner space of the inclined portion 423*c*, and the insertion portion 435*a* may be fixedly inserted into the inner space of the second cam 435 in the circumferential direction.

The inclined portion 423*c* of the second cam 423 may be inclined substantially the same as the inclined guide groove and inserted into the inclined guide groove formed between the inclined front side of the insertion portion 435*a* and the inclined rear side the pressing portion 435 to be guided.

Accordingly, when the second cam 423 moves in a forward direction of the body member 410 along the lengthwise direction, the inclination portion 423*c* of the second cam 423 may press the first cam 435 through a contact surface with the pressing portion 435*b* of the first cam 435. As the inclined portion 423*c* of the second cam 423 presses the pressing portion 435*b* of the first cam 435 in the lengthwise direction, the first cam 435 may be raised in the radial direction.

Dynamics between the inclined rear side of the pressing portion 435*b* and the inclined portion 423*c* when engaged with each other are the same as the one (or first) implementation, so a description thereof will be omitted.

In addition, when a centrifugal force is generated in the brush assembly 430 by rotation of the agitator 400, the inclined front side of the insertion portion 435*a* is pressed radially inward from the inner space of the second cam 423 by the inclined portion 423*c*, thereby preventing the brush assembly 430 from being extended by the centrifugal force.

Accordingly, the brush assembly 430 may not be extended by the centrifugal force without having to provide an elastic member at the brush assembly 430.

A spring 490 and a prevention separation portion 436 are operated in the same manner as the spring 390 and the prevention separation portion 336 of the agitator 300 illustrated in FIGS. 10A and 10B, so a description thereof will be omitted.

That is, the modified body member 410, the brush holder 432, and the shaft 420 may operate in combination with the remaining components of the agitator 300 of the another (or second) implementation.

Figure 13:
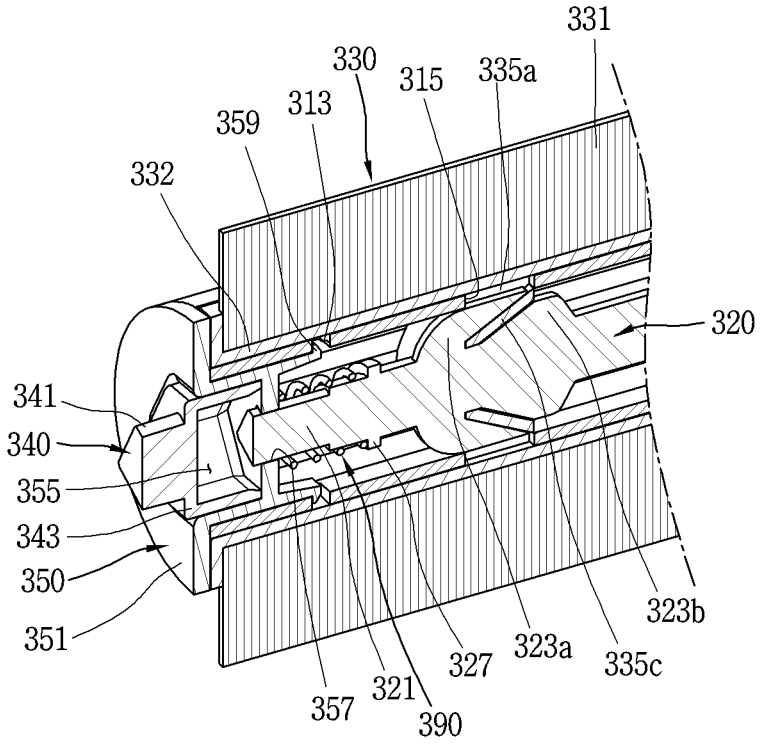
FIG. 13 is a cross-sectional perspective view illustrating a portion "V" of the agitator in FIG. 10A.

FIG. 13 is a cross-sectional perspective view illustrating a portion "V" of the agitator in FIG. 10A.

An inner cavity that is open toward the first guide hole 357 of the first end cap 360 may be defined in the agitator connecting portion 343 of the power transmission unit 340 that is inserted into the first cavity 355. The outer circumferential surface of the agitator connecting portion 343 may have a polygonal column shape to be engaged with the inner circumferential surface of the first cavity 355. Accordingly, when the power transmission unit 340 is rotated by the first power module 13*a* (see FIG. 14), a rotational force is transmitted to the first end cap 350 by the agitator connecting portion 343. As the first end cap 350 rotates, the body member 310 may be rotated.

The first guide hole 357 allows the front end portion 321 of the shaft 320 to be introduced into the inner cavity of the agitator connecting portion 343. The front end portion 321 of the shaft 320 reciprocates in the inner cavity of the agitator connecting portion 343 in the lengthwise direction.

An inner circumferential surface of the first guide hole 357 may have a polygonal column shape, and the outer circumferential surface of the front end portion 321 of the shaft 320 may also have a polygonal column shape corresponding thereto. As the inner circumferential surface of the first guide hole 357 and the outer circumferential surface of the front end portion 321 are engaged with each other, the shaft 320 may rotate together with the first end cap 350 without idling.

The rim portion 327 is provided at the outer circumferential surface of the connecting portion 324 that is connected to the front end portion 321 of the shaft 320 to be spaced apart from the front end portion 321 of the shaft 320 by a predetermined distance. The rim portion 327 radially extends from the outer circumferential surface of the connecting portion 324 along the circumferential direction. The spring 390 that surrounds the shaft 320 is inserted between the rim portion 327 and the first end cap 350. A front side of the spring 390 is coupled to the first end cap 350 and a rear side of the spring 390 is coupled to the rim portion 327.

When the front end portion 321 of the shaft 320 is moved to the inner cavity of the agitator connecting portion 343, the spring 390 is compressed between the first end cap 350 and the rim portion 327. Then, the spring 390 presses the rim portion 327 of the shaft 320 in the rearward direction of the shaft 320.

Hereinafter, a cleaning unit including components for controlling the agitator of the present disclosure and a method of controlling the same will be described in detail with reference to FIGS. 14 to 17.

In the following description, a description of some components may be omitted in order to clarify the technical characteristics of the present disclosure.

Figure 14:
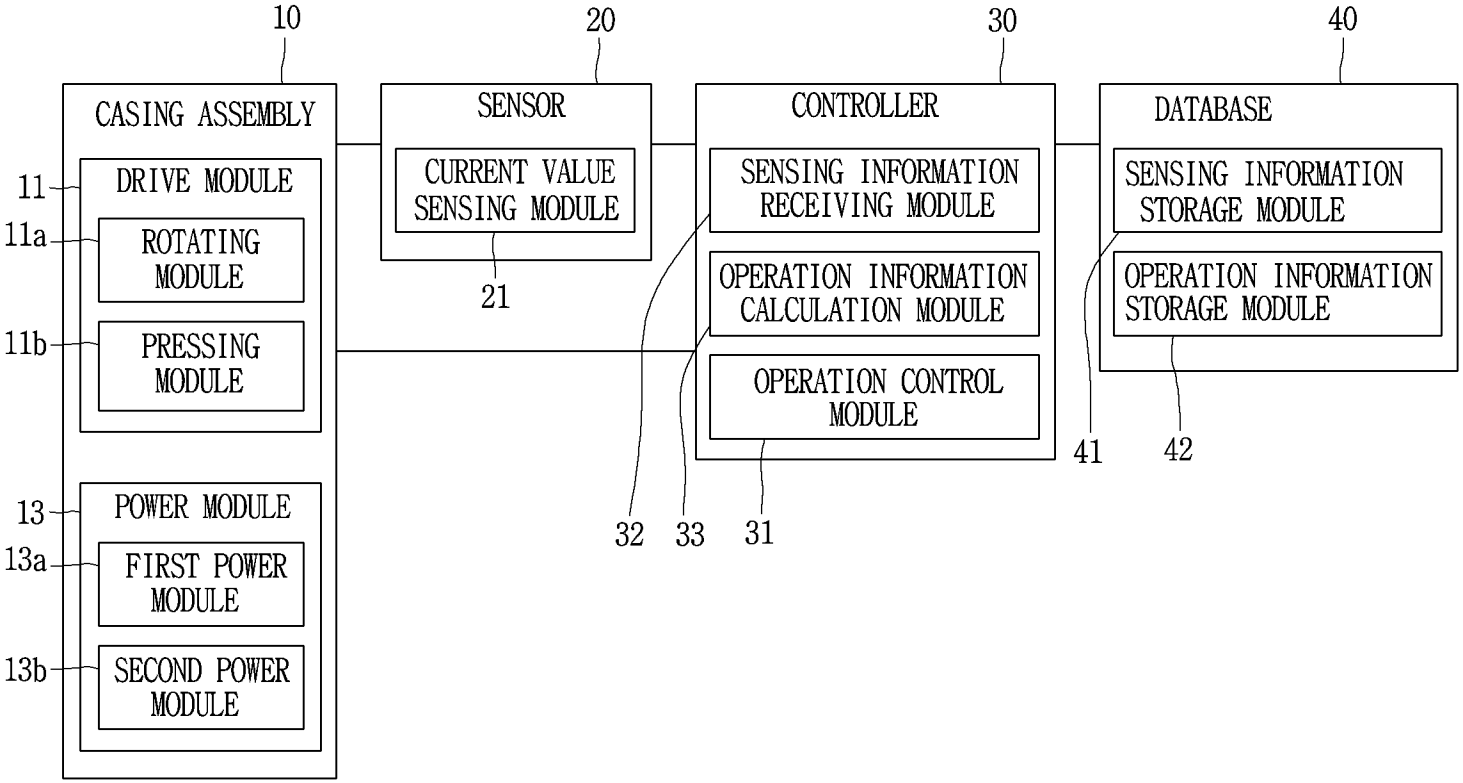
FIG. 14 is a block diagram illustrating a configuration for controlling a cleaning unit according to the present disclosure.

FIG. 14 is a block diagram illustrating a configuration for controlling a cleaning unit according to the present disclosure.

Referring to FIG. 14, the cleaning unit having components for controlling the agitator of the present disclosure includes a casing assembly 10, a sensor 20, a controller 30, and database 40.

First, the casing assembly 10 will be described.

The casing assembly 10 defines a casing of the cleaning unit of the present disclosure.

For example, the casing assembly 10 may be the cleaner body 110 in FIG. 1 illustrated to describe the related art robot cleaner.

A predetermined space is formed in the casing assembly 10. The sensor 20, the controller 30, and the database 40 may be provided in the space.

Also, the casing assembly 10 includes a drive (or driving) module 11 and a power module 13.

The drive module 11 may be driven by the power module 13. That is, a driving force generated by the power module 13 may be transmitted to the drive module 11.

In some implementations, the drive module 11 may include a rotating module 11*a* and a pressing module 11*b*. The agitators 200 and 300 according to the present disclosure may be used for the rotating module 11*a*, and the shaft accommodating parts 270 and 370 according to the present disclosure may be used for the pressing module 11*b*.

The power module 13 may include a first power module 13*a* and a second power module 13*b*. The first power module 13*a*, which is a module that generates a rotational force, may be connected to the rotating module 11*a* to rotate the rotating module 11*a*. The second power module 13*b*, which is a module that applies pressure in a specific direction, may be connected to the pressing module 11*b* to operate the pressing module 11*b*.

In some implementations, a servo motor that generates a rotational force may be used for the first power module 13*a*, and a linear servo motor that applies pressure in a specific direction may be used for the second power module 13*b*. However, other known power devices capable of generating a rotational force and applying pressure in a specific direction may be employed in addition to the servo motor and the linear servo motor.

The first power module 13*a* may allow the agitator 200 or 300 connected thereto to be rotated. During the rotation, the shaft accommodating part 270 or 370 may be pressed by the second power module 13*b* to cause the shaft 220 or 320 to move in its forward direction, allowing the brush assembly 230 or 330 to be extended in the radial direction.

In some implementations, the power module 13 may receive power from the outside. The power module 13 may be powered by a battery (not shown) provided at the cleaner body 110. The power module 13 may be electrically connected to the battery (not shown).

The first power module 13*a* and the second power module 13*b* may be driven independently. That is, rotation of the first power module 13*a* and the second power module 13*b*, the number of rotations, and the like may be controlled independently of each other. To this end, the first power module 13*a* and the second power module 13*b* may each be electrically connected to the controller 30.

Hereinafter, the sensor 20 will be described.

The sensor 20 may sense a value of current generated when the rotating module 11*a* is rotated by the first power module 13*a*. That is, the sensor 20 may sense the value of the current generated when the agitator 200 or 300 is rotated by the first power module 13*a*.

Information sensed or detected by the sensor 20 is transmitted to the controller 30, allowing the controller 30 to generate control information appropriate for a given condition or situation.

The sensor 20 may be provided in a form capable of sensing a current value of the first power module 13*a*.

The sensor 20 may be electrically connected to a battery (not shown). Power required for the sensor 20 to be operated may be supplied from the battery (not shown).

The sensor 20 includes a current value sensor module 21 capable of detecting a value of current. In some implementations, the current value sensor module 21 may measure a current value by using an ammeter that is electrically connected to a circuit, or by measuring a magnetic field.

As the current value sensor module 21 senses the current value of the first power module 13*a*, condition of a floor on which the cleaner is currently operated may be sensed.

When the cleaner preforms cleaning on a carpet, not a hard floor, wheels of the cleaner are buried under a predetermined depth of the carpet, and the current value requires for the first power module 13*a* to rotate the agitator 200 or 300 is increased accordingly.

The controller 30 may generate appropriate or proper operation information by comparing the current value detected by the current value sensor module 21 with a predetermined (or preset) current value to determine that the cleaner is located on the carpet.

The current value sensor module 21 may be connected to the first power module 13*a* to measure the current value of the first power module 13*a*.

Hereinafter, the controller 30 will be described.

The controller 30 receives a current value from the sensor 20 and calculates operation information for operating the second power module 13*b*.

In addition, the controller 30 is electrically connected to the sensor 20 to receive the current value detected by the sensor 20.

The controller 30 may calculate operation information using the received sensing information. Further, the controller 30 may control the second power module 13*b* based on the calculated operation information. To this end, the controller 30 is electrically connected to the second power module 13*b*.

The controller 30 is electrically connected to the database 40. Information detected by the sensor 20 and information calculated by the controller 30 may be stored in the database 40.

Various modules of the controller 30 described hereafter are electrically connected to each other, such that information input to one module or information calculated by one module may be transmitted to another module.

The controller 30 may be provided in a form capable of inputting, outputting, and calculating information. In some implementations, the controller 30 may be provided in the form of a microprocessor, a central processing unit (CPU), a printed circuit board (PCB), or the like.

The controller 30 is located at a predetermined space formed in the cleaner body 110. The controller 30 may be accommodated in the space in a hermetically sealed manner so as not to be affected by external moisture, and the like.

The controller 30 includes a sensing information receiving module 32, an operation information calculation module 33, and an operation control module 31.

The operation information calculation module 33 calculates operation information for operating the second power module 13*b*.

The operation information calculation module 33 may calculate operation information using a current value of the first power module 13*a* transmitted to the sensing information receiving module 32. The operation control module 31 is electrically connected to the operation information calculation module 33.

The operation information may be achieved by the operation control module 31. The operation control module 31 is configured to control the second power module 13*b* corresponding to the calculated operation information.

In detail, the operation information refers to information of pressing the shaft accommodating part 270 or 370 by the second power module 13*b*. As the shaft accommodating part 270 or 370 is pressed by the second power module 13*b*, the brush assembly 230 or 330 may be extended while the agitator 200 or 300 is rotating.

Hereinafter, the database 40 will be described.

The database 40 stores information regarding operation of the cleaner.

The database 40 may be provided in a form capable of inputting, outputting, and storing information. In some implementations, the database 40 may be provided in the form of an SD card, a micro SD card, USB memory, an SSD, or the like.

The database 40 is electrically connected to the operation information calculation module 33. Operation information calculated by the operation information calculation module 33 may be transmitted to the database 40 to be stored.

The database 40 is electrically connected to the sensor 20 through the sensing information receiving module 32. A current value detected by the sensor 20 may be transmitted to the database 40 to be stored.

The database 40 includes a sensing information storage module 41 and an operation information storage module 42. The modules 41 and 42 may be electrically connected to each other.

The operation information storage module 42 stores operation information calculated by the operation information calculation module 33. The operation information storage module 42 is electrically connected to the operation information calculation module 33.

The sensing information storage module 41 may store sensing information according to specific operation information. The sensing information storage module 41 is electrically connected to the operation information storage module 42.

A process of sensing by the sensor 20, information processing and a process of calculation by the controller 30, and a process of storing information in the database 40 may be performed in real time.

Hereinafter, a method of controlling length extension of the brush assembly of the cleaning unit according to the present disclosure will be described in detail with reference to FIGS. 15 to 17.

Figure 15:
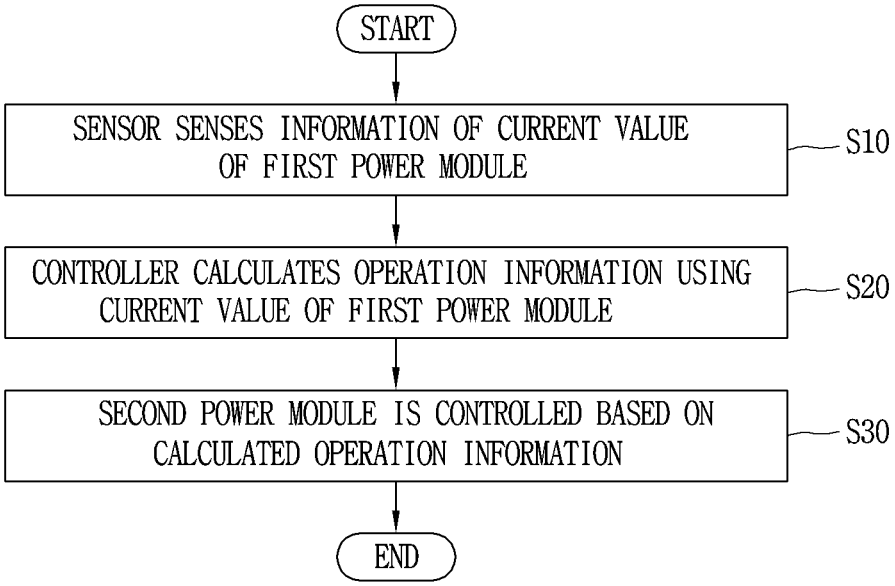
FIG. 15 is a flowchart illustrating a method of controlling a cleaning unit according to the present disclosure.

FIG. 15 is a flowchart illustrating a method of controlling a cleaning unit according to the present disclosure.

When the cleaner is operated on the floor, the sensor 20 detects a current value of the first power module 13*a* (S10).

The first power module 13*a* is connected to the agitator 200 or 300 of the cleaner to rotate the agitator 200 or 300. The agitator 200 or 300 is connected to the suction nozzle module 120. When the suction nozzle module 120 slidably moves on the floor, the agitator 200 or 300 is exposed to the floor to rotate.

When the suction nozzle module 120 is moved by the wheel module 160 off from the floor with a predetermined distance. When the cleaner travels on a hard floor surface, the agitator 200 or 300 provided at the suction nozzle module 120 is rotated at a specific distance away from the floor.

When the cleaner is moved from the hard floor surface to a carpet, the wheel module 160 is buried under a predetermined depth of the carpet, which allows the agitator 200 or 300 to be located closer to the carpet than the hard floor surface.

Accordingly, the brush 231 or 331 of the agitator 200 or 300 receives more resistance compared to the hard floor surface, causing more amount of current to flow in the first power module 13*a* that rotates the agitator 200 or 300.

A current value flowing through the first power module 13*a* may be detected by the current value sensing module 21 included in the sensor 20.

When the current value sensing module 21 detects the current value flowing through the first power module 13*a*, the controller 30 calculates operation information using the current value of the first power module 13*a* (S20).

The current value of the first power module 13*a* measured by the current value sensing module 21 is received by the sensing information receiving module 32 of the controller 30, and the operation information calculation module 33 calculates operation information using the current value received by the sensing information receiving module 32.

When the operation information calculation module 33 calculates the operation information, the second power module 13*b* is controlled based on the calculated operation information (S30).

The operation information calculated by the operation information calculation module 33 is transmitted to the operation control module 31, and the second power module 13*b* is operated by the operation control module 31 according to the operation information.

The operation information includes information of applying pressure to the shaft accommodating part 270 or 370 at a predetermined pressure by the second power module 13*b*, or of stopping the second power module 13*b*.

The process of calculating operation information by the operation information calculation module 33 will be described in detail with reference to FIGS. 16 and 17.

Figure 16:
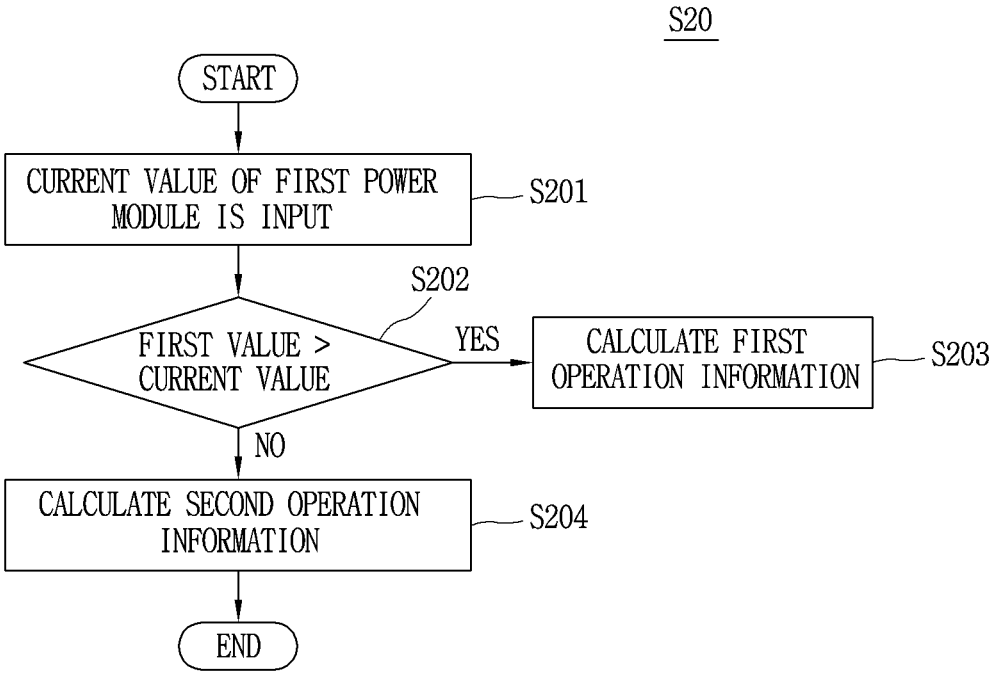
FIG. 16 is a flowchart illustrating one example of a step S20 of FIG. 15.

FIG. 16 is a flowchart illustrating one example of a step S20 of FIG. 15.

A current value of the first power module 13*a* is input to allow the controller 30 to calculate operation information using the current value (S201).

The current value of the first power module 13*a* is transmitted to the sensing information receiving module 32 of the controller 30, and the operation information calculation module 33 compares it with a predetermined (or preset) first value (S202).

When the transmitted current value is less than the predetermined first value, the operation information calculation module 33 calculates first operation information (S203).

The first value is a set value of current flowing in the first power module 13*a* when the first power module 13*a* is driven on a carpet. When the transmitted current value is less than the first value, the operation information calculation module 33 determines that the cleaner is used or operated on a hard floor surface, not the carpet.

That is, the first operation information includes information that causes the first power module 13*a* to stop without being operated.

The first operation information is transmitted to the operation control module 31, and the operation control module 31 controls such that the second power module 13*b* is not operated.

When the transmitted current value is greater than the predetermined first value, the operation information calculation module 33 calculates second operation information (S204).

The first value is a set value of current flowing in the first power module 13*a* when the first power module 13*a* is driven on the carpet. When the transmitted current value is greater than the first value, the operation information calculation module 33 determines that the cleaner is operated on the carpet.

In other words, the second operation information includes information of pressing the shaft accommodating part 270 or 370 at a predetermined pressure by the first power module 13*a* to extend the length of the brush assembly 230 or 330 of the agitator 200 or 300 in rotation.

That is, the second operation information is transmitted to the operation control module 31, and the operation control module 31 controls the second power module 13*b* to press the pressing module 11*b* at a predetermined pressure.

Alternatively, in another example of the step S20, the brush assembly 230 or 330 of the agitator 200 or 300 may be controlled to be extended in several steps or in a stepwise manner.

As a fabric (or texture), length, and shape of a carpet used at home vary, cleaning may be performed more efficiently by providing multiple length adjustment options for the brush 231 or 331 of the agitator 200 or 300.

Figure 17:
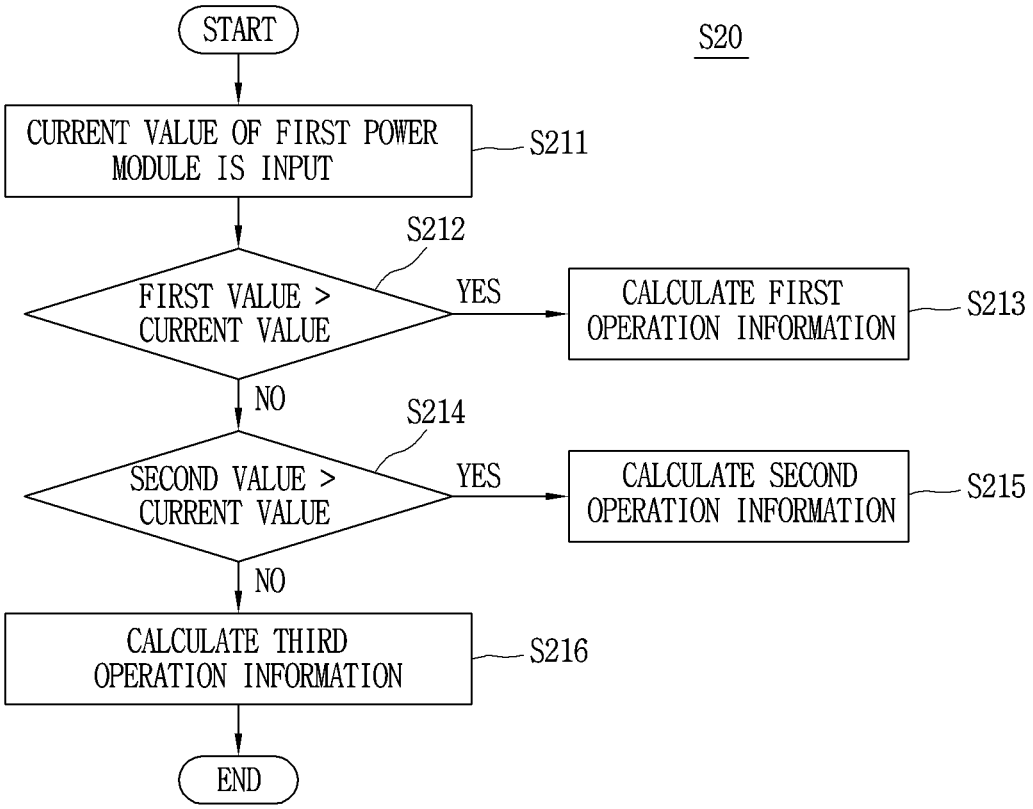
FIG. 17 is a flowchart illustrating another example of a step S20 of FIG. 15.

FIG. 17 illustrates a flowchart of another example of a step S20 in FIG. 15.

A current value of the first power module 13*a* is input to allow the controller 30 to calculate operation information using the current value (S211).

The current value of the first power module 13*a* is transmitted to the sensing information receiving module 32 of the controller 30, and the operation information calculation module 33 compares it with a predetermined (or preset) first value (S212).

When the transmitted current value is less than the predetermined first value, the operation information calculation module 33 calculates first operation information (S213).

The current value greater than or equal to the first value is a set value of current flowing through the first power module 13*a* when the first power module 13*a* is driven on a carpet. When the transmitted current value is less than the first value, the operation information calculation module 33 determines that the cleaner is used or operated on a hard floor surface, not the carpet.

That is, the first operation information includes information that causes the first power module 13*a* to stop without being operated.

The first operation information is transmitted to the operation control module 31, and the operation control module 31 controls such that the second power module 13*b* is not operated.

When the transmitted current value is greater than the predetermined first value, the operation information calculation module 33 compares it with a predetermined second value (S214).

The second value is greater than the first value. When the transmitted current value is less than the second value, the operation information calculation module 33 calculates second operation information (S215).

That is, when the transmitted current value is greater than or equal to the first value and less than the second value, the operation information calculation module 33 calculates the second operation information.

The current value greater than or equal to the first value and less than the second value is a set value of current flowing through the first power module 13*a* when the first power module 13*a* is driven on the carpet. When the transmitted current value is greater than or equal to the first value and less than the second value, the operation information calculation module 33 determines that the cleaner is operated on the hard floor surface, not the carpet.

In other words, the second operation information includes information of pressing the shaft accommodating part 270 or 370 at a predetermined first pressure by the first power module 13*a* to extend the length of the brush assembly 230 or 330 of the agitator 200 or 300 in rotation.

That is, the second operation information is transmitted to the operation control module 31, and the operation control module 31 controls the second power module 13*b* to press the pressing module 11*b* at the predetermined first pressure.

When the transmitted current value is greater than or equal to the second value, the operation information calculation module 33 calculates third operation information.

The current value greater than or equal to the second value is a set value of current flowing through the first power module 13*a* when the first power module 13*a* is driven on a second (another) carpet. When the transmitted current value is greater than or equal to the second value, the operation information calculation module 33 determines that the cleaner is operated on the second carpet.

The third operation information includes information of pressing the shaft accommodating part 270 or 370 at a predetermined second pressure by the first power module 13*a* to extend the length of the brush assembly 230 or 330 of the agitator 200 or 300 in rotation.

That is, the third operation information is transmitted to the operation control module 31, and the operation control module 31 controls the second power module 13*b* to press the pressing module 11*b* at the predetermined second pressure.

The second pressure is greater than the first pressure, and an extended length of the brush 231 or 331 when pressed at the second pressure by the pressing module 11*b* is greater than an extended length of the brush 231 or 331 when pressed at the first pressure by the pressing module 11*b*.

That is, the second carpet is an environment that requires a stronger force of stroke than the first carpet, such that the brush 231 or 331 is extended longer by determining this based on the magnitude of the current value.

In FIG. 17, the length of the brush 231 or 331 is extended by two steps (or stages), however the brush 231 or 331 may be controlled to be extended by more than two steps.

For example, when values of current are classified into a first value, a second value, and a third value, the operation information calculation module 33 may be configured to: calculate first operation information for stopping the pressing module 11*b* when a sensed or detected current value is less than the first value; calculate second operation information for pressing the pressing module 11*b* at a first pressure when a detected current value is greater than or equal to the first value and less than the second value; calculate third operation information for pressing the pressure module 11*b* at a second pressure when a detected current value is greater than or equal to the second value and less than the third value; and calculate fourth operation information for pressing the pressing module 11*b* at a third pressure when a detected current value is greater than the third value.

The second value may be set as a value that is greater than the first value and less than the third value, and the second pressure may be set as a value that is greater than the first pressure and less than the third pressure, allowing the brush 231 or 331 to be extended by the three steps. Similarly, the brush may be extended to four, five or more steps.

Although not shown, a control signal input module for allowing a user to input a control signal is provided at the cleaner, such that the brush assembly is configured to be extended according to the control signal input by the user.

For example, when the user inputs a first signal, first operation information for stopping the second power module is calculated by the operation information calculation module. When the user inputs a second signal, second operation information for pressing the pressing module at a predetermined pressure is calculated. Similarly, the brush assembly may be sequentially extended when a control signal is input by the user. The control signal input module may be configured to be input manually by the user, or may be configured to allow the user to input a control signal through a terminal, or the like. In some implementations, the terminal may be a smart phone, and the like.

Cleaning performance on the carpet may be improved by extending the length of the brush 231 or 331 when cleaning the carpet.

As the length of brush 231 or 331 is extended in a stepwise manner according to carpet environment or condition, the cleaning performance on the carpet can be improved and the cleaner can be used more efficiently.

As described above, the cleaning unit according to the present disclosure may be used in a device that is automatically operated, such as a robot cleaner, so as to be automatically controlled such that the length of the brush assembly can be extended according to floor conditions.

The brush assembly 230 or 330 of the cleaning unit having the agitator 200 or 300 according to the present disclosure may not only be extended by the automatic control, but also be extended by a mechanical component connected to the shaft accommodating part 270 or 370 that can press the shaft 220 or 320. For example, the brush assembly 230 or 330 may be mechanically extended according to a button manipulation by the user.

The foregoing description has been given of the preferred implementations, but it will be apparent to those skilled in the art that various modifications and variations can be made in the present disclosure without departing from the scope of the disclosure as defined in the appended claims.

What is claimed is:

1. A cleaning unit comprising:

a power module;

a body part rotatably connected to the power module and includes a first through-hole defined in an outer circumferential surface thereof;

a shaft that is inserted into a hollow hole of the body part in a lengthwise direction of the body part and performs a reciprocating motion in the body part in the length wise direction of the body part;

a brush assembly in contact with the outer circumferential surface of the body part along the lengthwise direction of the body part;

a first cam extending from a surface of the brush assembly in contact with the outer circumferential surface of the body part toward an outer circumferential surface of the shaft through the first through-hole; and a second cam extending from the outer circumferential surface of the shaft toward the first cam, wherein one of the first cam and the second cam is provided at one side thereof with an inclined surface that is inclined along the length wise direction of the body part, and wherein a remaining one of the first cam and the second cam presses the inclined surface as the shaft performs the reciprocating motion, so that the brush assembly moves upward and downward in a radial direction of the shaft.

2. The cleaning unit of claim 1, wherein the body part comprises:

a body member provided with the first through-hole and having a hollow shape with both ends open;

a first end cap that is inserted into the body member from one end of the body member by a predetermined length so as to cover the one end of the body member and accommodates one side of the shaft; and a second end cap that is inserted into the body member from another end of the body member by a predetermined length so as to cover the another end of the body member and accommodates another side of the shaft.

3. The cleaning unit of claim 2, wherein the brush assembly comprises:

a brush; and a brush holder that is in contact with an outer circumferential surface of the body member in a lengthwise direction of the shaft, and has one side thereof provided with the first cam and another side thereof coupled to the brush.

4. The cleaning unit of claim 3, wherein the body member is provided with an accommodation groove in which the brush holder is accommodated along the lengthwise direction of the shaft, wherein the first end cap covers one end of the accommodation groove, wherein the second end cap covers another end of the accommodation groove, wherein each of the first end cap and the second end cap is provided with a radial guide groove, the radial guide grooves formed on a surface of the first end cap that covers the one end of the accommodation groove and a surface that covers the another end of the accommodation groove, respectively, wherein the brush holder is provided with radial guide protrusions formed on a surface opposite to the first end cap and a surface opposite to the second end cap, respectively, and wherein the radial guide protrusions are inserted into the radial guide grooves, respectively, so as to be guided in the radial direction of the shaft.

5. The cleaning unit of claim 2, wherein a cavity is recessed from one side of the first end cap toward the body member, and a guide hole is defined in another side of the first end cap to accommodate an end portion of the one side of the shaft so as to guide the end portion of the one side of the shaft to the cavity.

6. The cleaning unit of claim 5, wherein the end portion of the one side of the shaft and the guide hole each have a polygonal column shape to be engaged with each other.

7. The cleaning unit of claim 6, further comprising a power transmission unit having one side connected to the power module and another side inserted into the cavity, wherein the cavity and the another side of the power transmission unit each have a polygonal column shape to be engaged with each other.

8. The cleaning unit of claim 2, wherein a cavity is recessed from one side of the second end cap toward the body member, and a guide hole is defined in another side of the second end cap to accommodate the another side of the shaft to allow the another side of the shaft to protrude to the cavity, so as to support the another side of the shaft in the radial direction of the shaft.

9. The cleaning unit of claim 8, further comprising a shaft accommodating part that includes an accommodation space in which an end portion of the another side of the shaft is accommodated and a bearing that is inserted between an outer circumferential surface of the end portion of the another side of the shaft and an inner circumferential surface of the accommodation space.

10. The cleaning unit of claim 9, wherein the power module comprises:

a first power module configured to rotate the shaft;

a second power module that is connected to the shaft accommodating part and is configured to press the shaft accommodating part according to operation information;

a sensor connected to the first power module to detect a current value of the first power module; and a controller that is configured to calculate the operation information, is electrically connected to the second power module to transmit the calculated operation information to the second power module, and is electrically connected to the sensor to receive the current value of the first power module, and wherein the controller calculates the operation information using the detected current value of the first power module.

11. The cleaning unit of claim 10, wherein the operation information includes first operation information and second operation information, wherein the second power module is configured to:

stop upon receiving the first operation information; and press the shaft accommodating part at a predetermined pressure upon receiving the second operation information, and wherein the controller is configured to:

calculate the first operation information when the detected current value of the first power module is less than a first value; and calculate the second operation information when the detected current value of the first power module is greater than or equal to the first value.

12. The cleaning unit of claim 10, wherein the operation information includes first operation information, second operation information, and third operation information, wherein the second power module is configured to:

stop upon receiving the first operation information;

press the shaft accommodating part at a first pressure upon receiving the second information; and press the shaft accommodating part at a second pressure upon receiving the third information, wherein the controller is configured to:

calculate the first operation information when the detected current value of the first power module is less than a first value, calculate the second operation information when the detected current value of the first power module is greater than or equal to the first value; and calculate the third operation information when the detected current value of the first power module is greater than or equal to a second value, and wherein the second pressure is greater than the first pressure, and the second value is greater than the first value.

13. The cleaning unit of claim 10, wherein the first power module is a servo motor configured to generate a rotational force, and the second power module is a linear servo motor configured to apply pressure in a specific direction.

14. The cleaning unit of claim 1, wherein a second through-hole is defined in the outer circumferential surface of the body part, and wherein the brush assembly is provided with an elastic member that extends from one side thereof to an inside of the body part through the second through-hole and presses an inner surface of the body member as the brush assembly is raised in the radial direction.

15. The cleaning unit of claim 14, wherein the elastic member comprises:

a first elastic portion extending from the one side of the brush assembly to the inside of the body part through the second through-hole; and a second elastic portion bent from the first elastic portion to extend along a lengthwise direction of the shaft.

16. The cleaning unit of claim 1, wherein a third through-hole is defined in the outer circumferential surface of the body part, and wherein the brush assembly is provided with a separation prevention portion that extends from one side thereof to an inside of the body part through the third through-hole and at least partially overlaps the body part in the radial direction of the shaft.

17. A cleaning unit comprising:

a power module;

a body part rotatably connected to the power module and includes a first through-hole defined in an outer circumferential surface thereof;

a shaft that is inserted into a hollow hole in the body part in a length wise direction of the body part and performs a reciprocating motion in the body part in the lengthwise direction of the body part;

a brush assembly in contact with the outer circumferential surface of the body part along the lengthwise direction of the body part;

a first cam extending from a surface of the brush assembly in contact with the outer circumferential surface of the body part toward an outer circumferential surface of the shaft through the through-hole; and a second cam extending from the outer circumferential surface of the shaft toward the first cam, wherein one of the first cam and the second cam comprises:

a pair of wall portions each having an end portion that is inclined along a length wise direction of the shaft; and an inclined portion that connects between the end portions of the pair of wall portions to form an inner space, wherein a remaining one of the first cam and the second cam comprises:

an insertion portion slidably inserted into the inner space of the inclined portion along one surface of the inclined portion; and a pressing portion in contact with another surface of the inclined portion to press the another surface of the inclined portion, and wherein the inclined portion is pressed as the shaft performs the reciprocating motion, so that the brush assembly moves upward and downward in a radial direction of the shaft.

18. The cleaning unit of claim 17, wherein the body part comprises:

a body member provided with the through-hole and having a hollow shape with both ends open;

a first end cap that is inserted into the body member from one end of the body member by a predetermined length so as to cover the one end of the body member and accommodates one side of the shaft; and a second end cap that is inserted into the body member from another end of the body member by a predetermined length so as to cover the another end of the body member and accommodates another side of the shaft.

19. The cleaning unit of claim 18, wherein a rim portion that protrudes from the outer circumferential surface of the shaft by a predetermined length in the radial direction of the shaft is provided at the one side of the shaft, and wherein the shaft includes a spring that surrounds the one side of the shaft and has both ends fixedly coupled to the first end cap and the rim portion, respectively.

20. The cleaning unit of claim 19, wherein a cavity is recessed from one side of the first end cap toward an inside of the body member, wherein a guide hole is defined in another side of the first end cap to guide an end portion of the one side of the shaft to the cavity, wherein an inner circumferential surface of the guide hole and an outer circumferential surface of the end portion of the one side of the shaft are engaged with each other, and wherein a stepped surface is formed between the outer circumferential surface of the end portion of the one side of the shaft that is accommodated in the guide hole and an outer circumferential surface of a connecting portion that is connected to the end portion of the one side of the shaft.

* * * * *